US011289019B2

(12) United States Patent
Toyomura

(10) Patent No.: US 11,289,019 B2
(45) Date of Patent: Mar. 29, 2022

(54) PIXEL CIRCUIT, DISPLAY DEVICE, METHOD FOR DRIVING PIXEL CIRCUIT, AND ELECTRONIC APPARATUS

(71) Applicant: Sony Semiconductor Solutions Corporation, Kanagawa (JP)

(72) Inventor: Naobumi Toyomura, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 16/758,510

(22) PCT Filed: Oct. 26, 2018

(86) PCT No.: PCT/JP2018/039800
§ 371 (c)(1),
(2) Date: Apr. 23, 2020

(87) PCT Pub. No.: WO2019/087950
PCT Pub. Date: May 9, 2019

(65) Prior Publication Data

US 2020/0251051 A1 Aug. 6, 2020

(30) Foreign Application Priority Data

Oct. 30, 2017 (JP) ..... JP2017-209327

(51) Int. Cl.
*G09G 3/32* (2016.01)
*G09G 3/325* (2016.01)

(52) U.S. Cl.
CPC ..... *G09G 3/325* (2013.01); *G09G 2300/0814* (2013.01); *G09G 2300/0819* (2013.01);
(Continued)

(58) Field of Classification Search
None
See application file for complete search history.

(56) References Cited

U.S. PATENT DOCUMENTS

2006/0077134 A1 4/2006 Hector et al.
2010/0253710 A1 10/2010 Rankov et al.
(Continued)

FOREIGN PATENT DOCUMENTS

CN 205920745 U 2/2017
EP 2 806 421 A1 11/2014
(Continued)

OTHER PUBLICATIONS

Japanese Office Action dated Jun. 8, 2021 for corresponding Japanese Application No. 2017-209327.

*Primary Examiner* — Carl Adams
(74) *Attorney, Agent, or Firm* — Michael Best & Friedrich LLP

(57) ABSTRACT

There is provided a pixel circuit including: a light-emitting element; a driving transistor whose source is connected to an anode of the light-emitting element; a sampling transistor, whose source is connected to a gate of the driving transistor, that samples a signal voltage to be written to the driving transistor; and a reset transistor that resets the anode of the light-emitting element to a predetermined potential at a predetermined timing. The reset transistor switches from on to off before the signal voltage is written to the driving transistor, switches from off to on while the signal voltage is being written to the driving transistor after the switching, and switches from on to off before a period in which the light-emitting element emits light after the writing.

20 Claims, 21 Drawing Sheets

(52) U.S. Cl.
CPC ..... *G09G 2320/0209* (2013.01); *G09G 2320/066* (2013.01)

(56) References Cited

U.S. PATENT DOCUMENTS

| | | | | |
|---|---|---|---|---|
| 2016/0005356 | A1 | 1/2016 | Zhang | |
| 2016/0104423 | A1 | 4/2016 | Park et al. | |
| 2016/0125808 | A1* | 5/2016 | Hsu | G09G 3/3233 345/212 |
| 2016/0307499 | A1 | 10/2016 | Toyomura et al. | |
| 2017/0047010 | A1* | 2/2017 | Chen | G09G 3/3233 |
| 2017/0053595 | A1 | 2/2017 | Liu et al. | |
| 2017/0124939 | A1 | 5/2017 | Kang et al. | |
| 2019/0057646 | A1* | 2/2019 | Lin | G09G 3/3233 |

FOREIGN PATENT DOCUMENTS

| | | | |
|---|---|---|---|
| JP | 2008145647 | A | 6/2008 |
| JP | 2008287140 | A | 11/2008 |
| JP | 2010282223 | A | 12/2010 |
| JP | 2011507005 | A | 3/2011 |
| JP | 2011164133 | A | 8/2011 |
| JP | 2014228863 | A | 12/2014 |
| JP | 2015-034861 | A | 2/2015 |
| JP | 2016212418 | A | 12/2016 |

* cited by examiner

[Fig. 1]
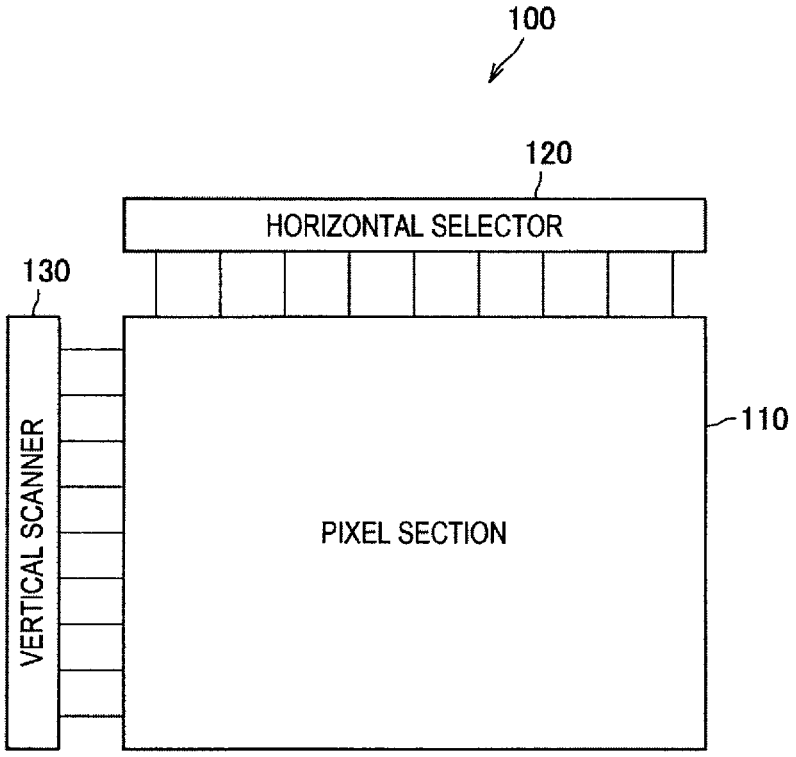

[Fig. 2]
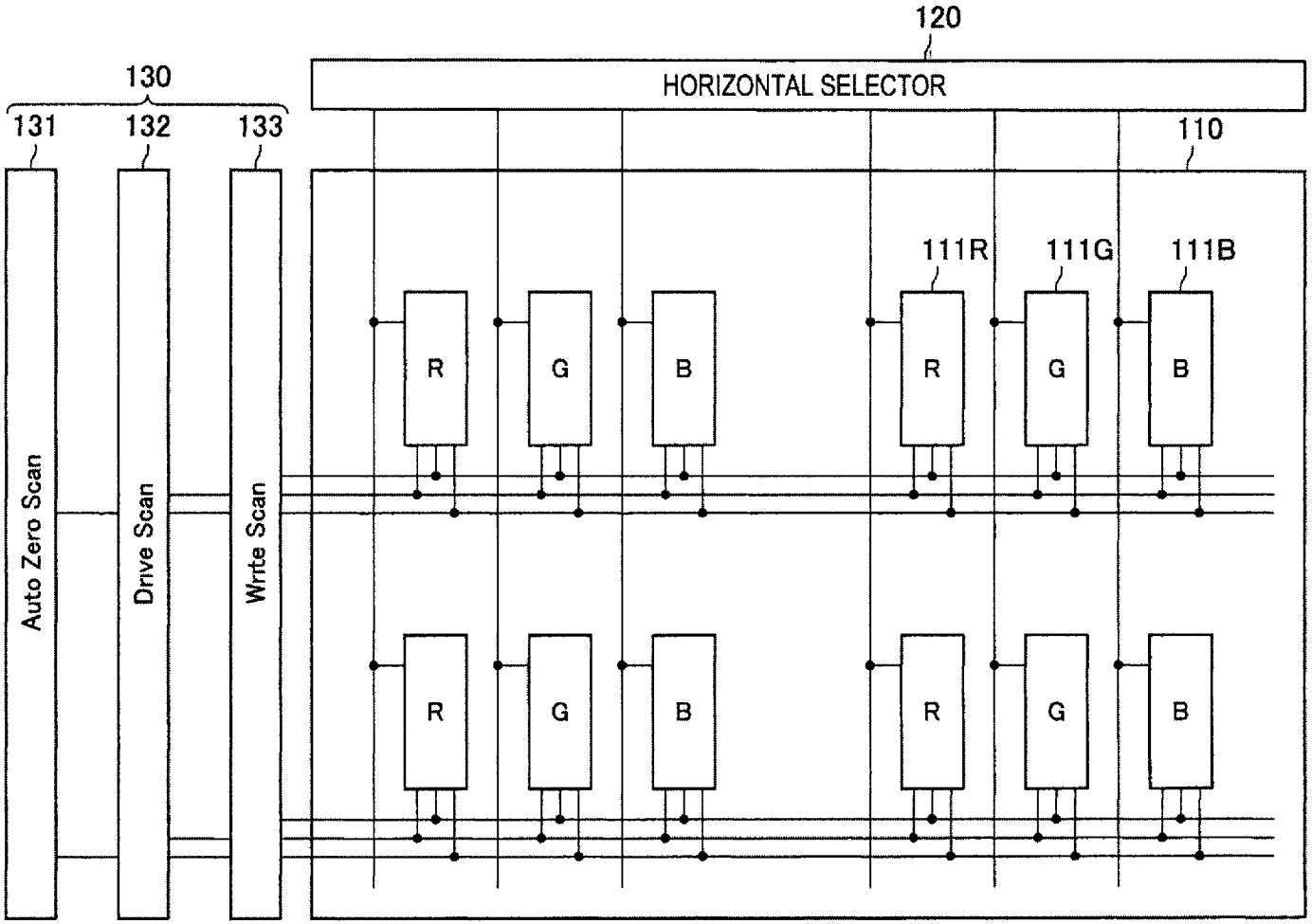

[Fig. 3]
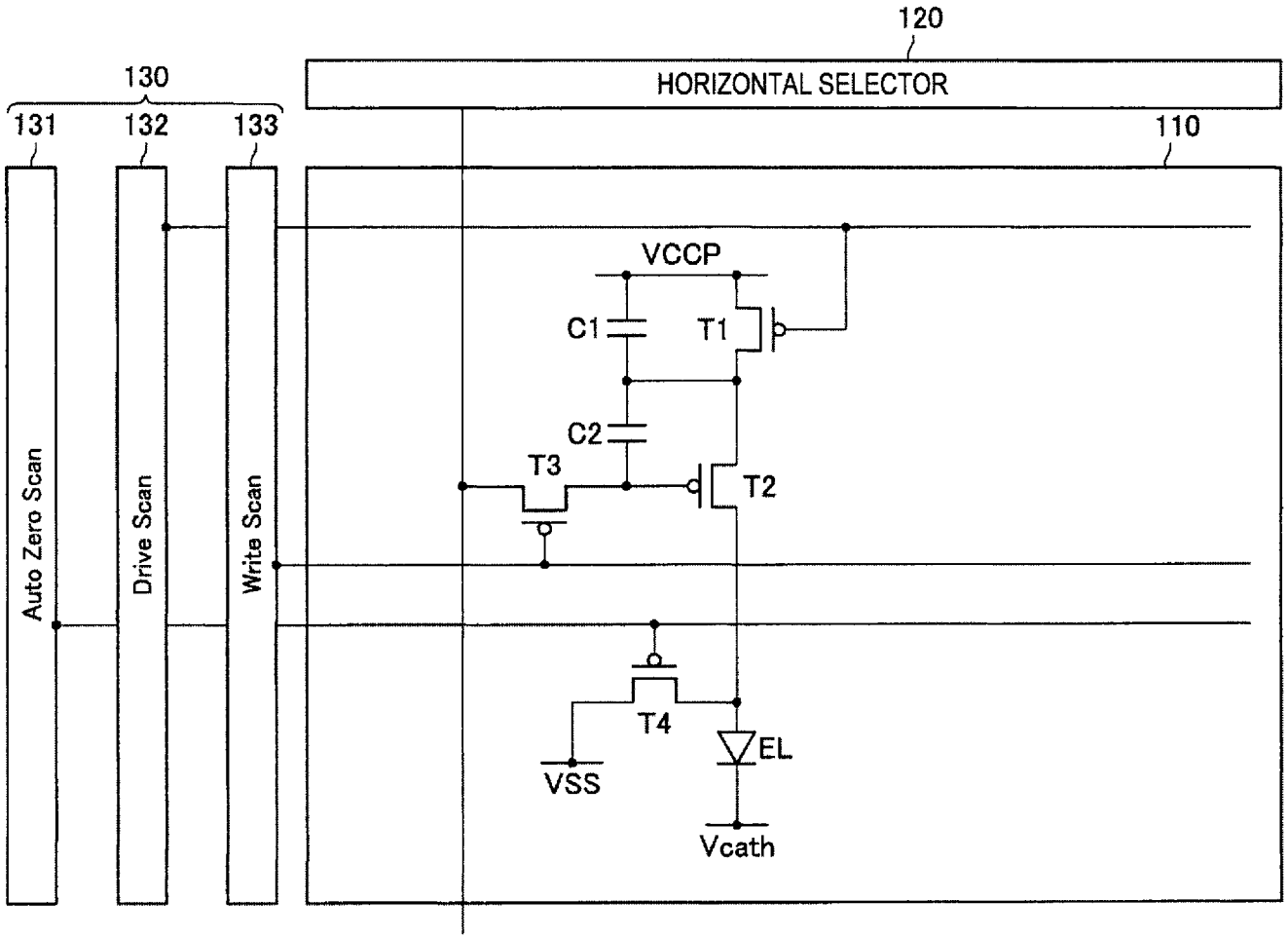

[Fig. 4]
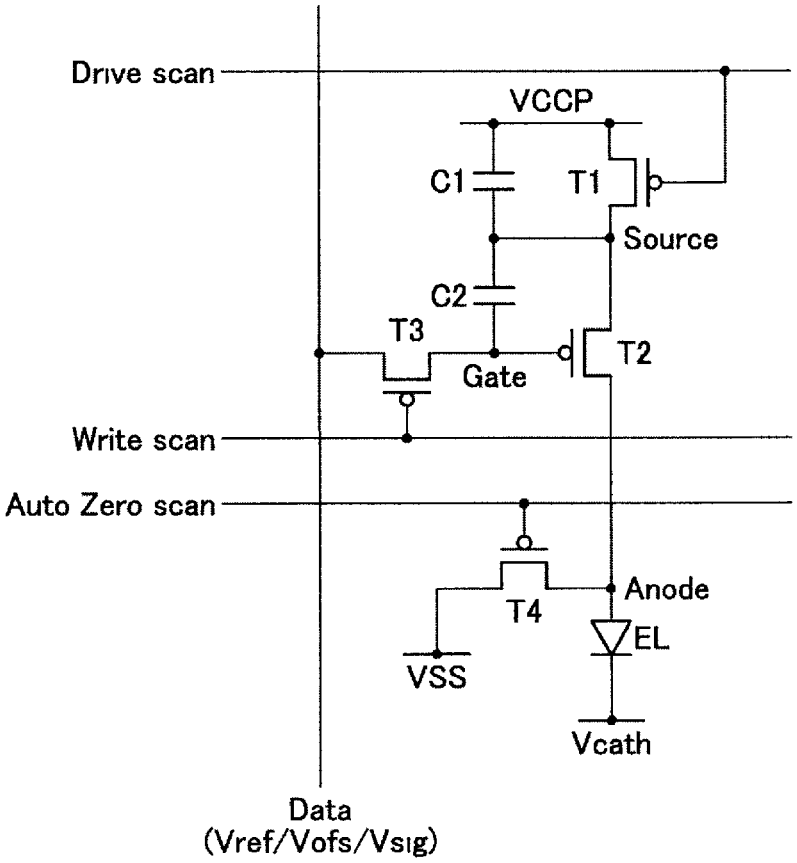

[Fig. 5]
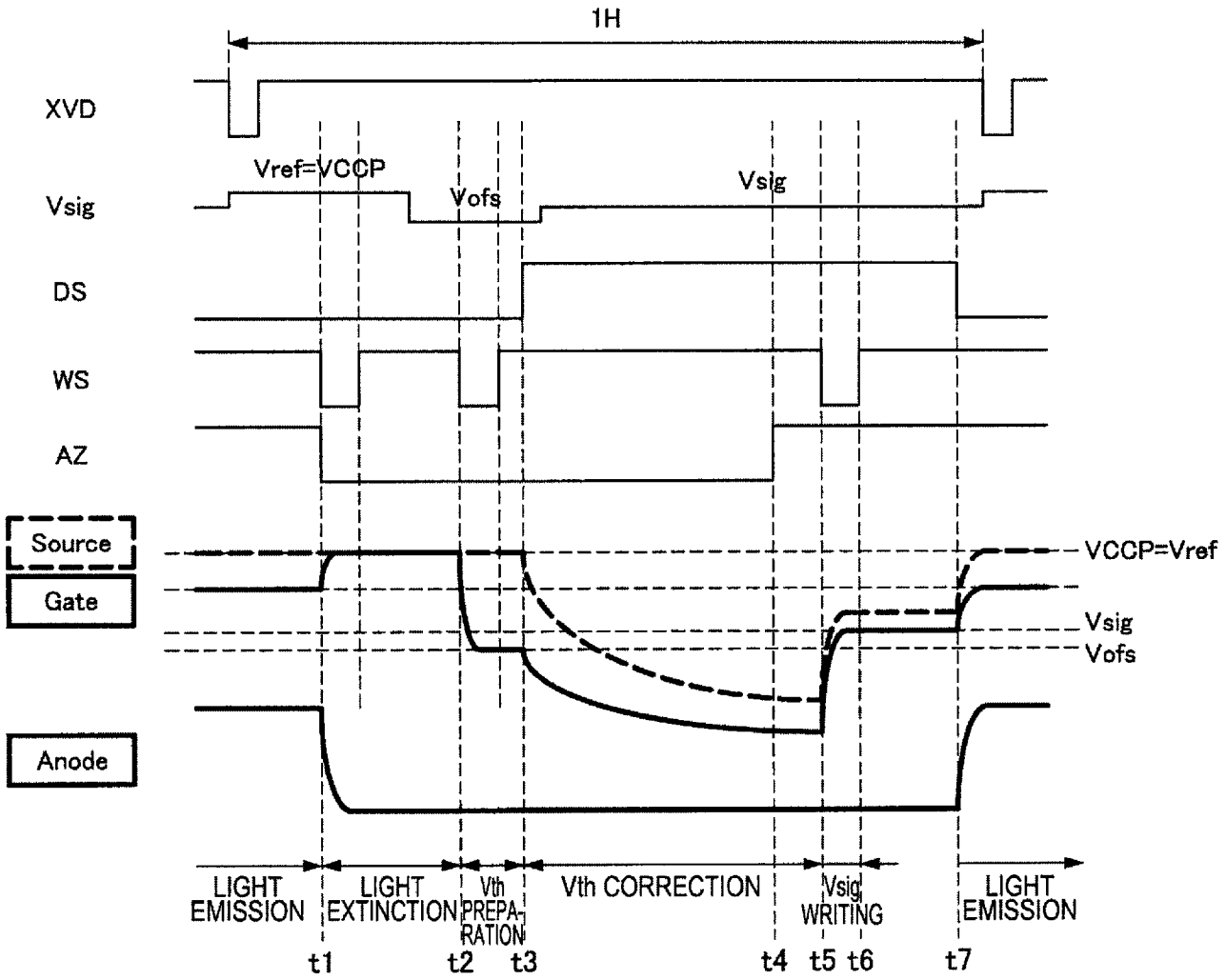

[Fig. 6]
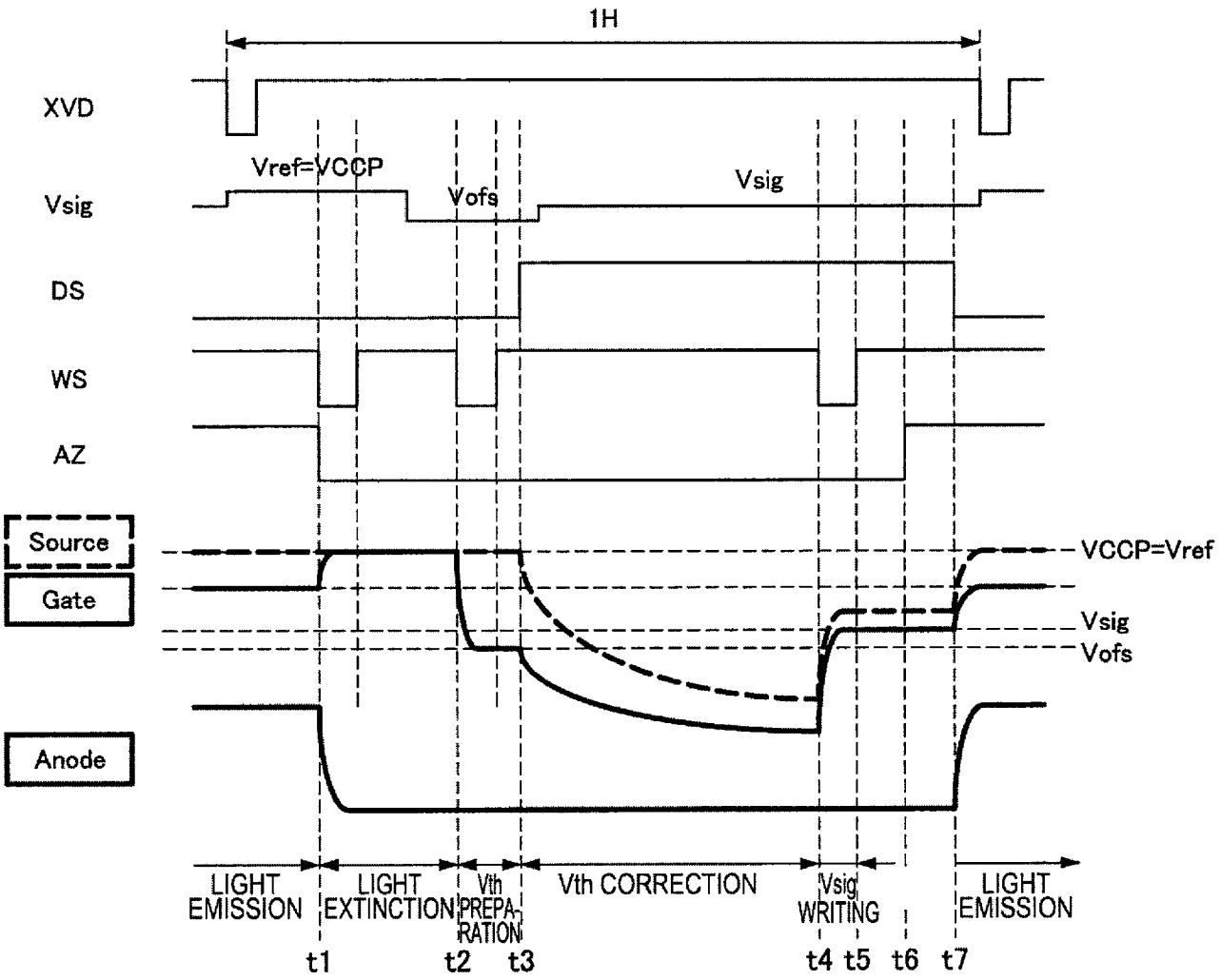

[Fig. 7]
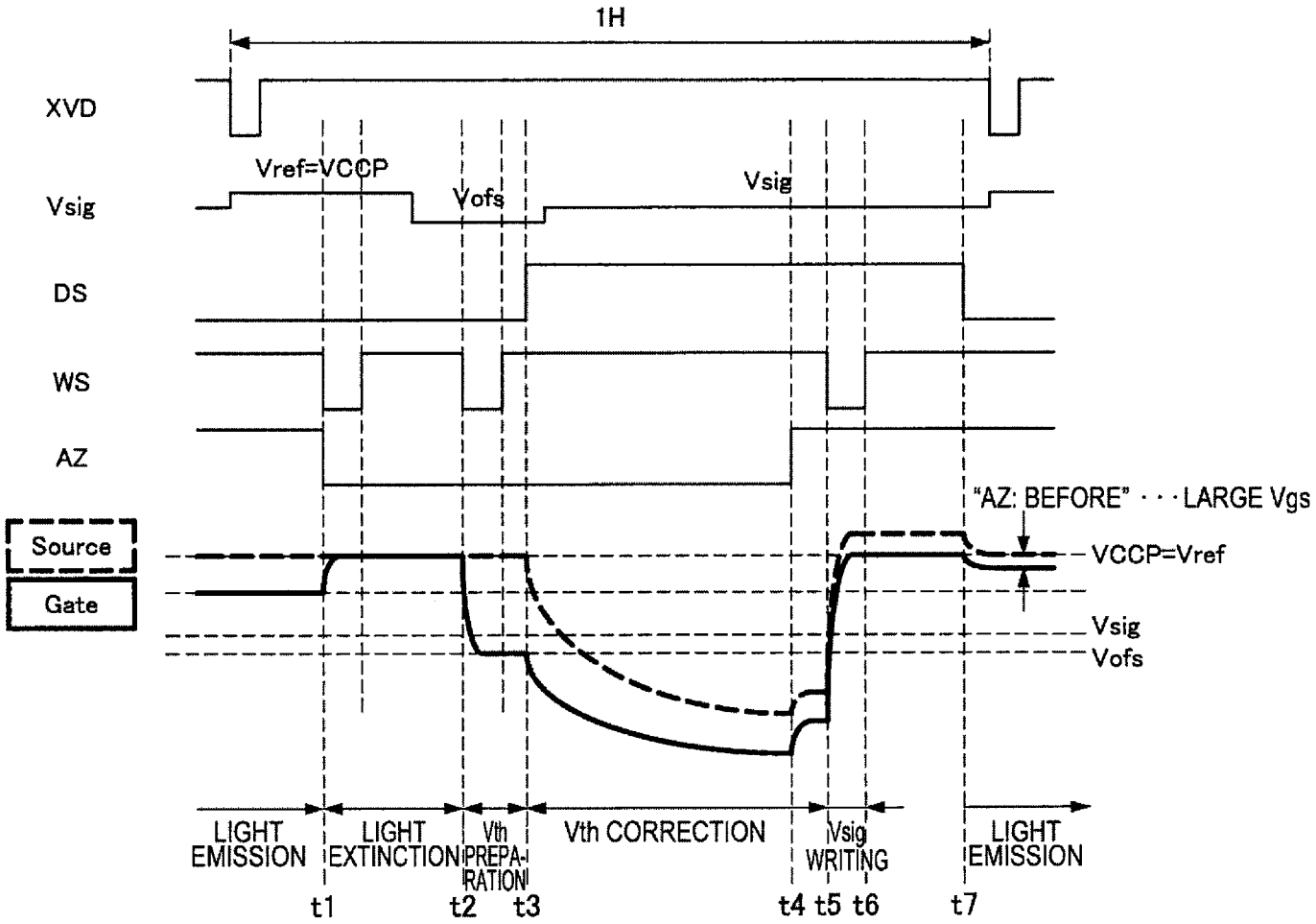

[Fig. 8]
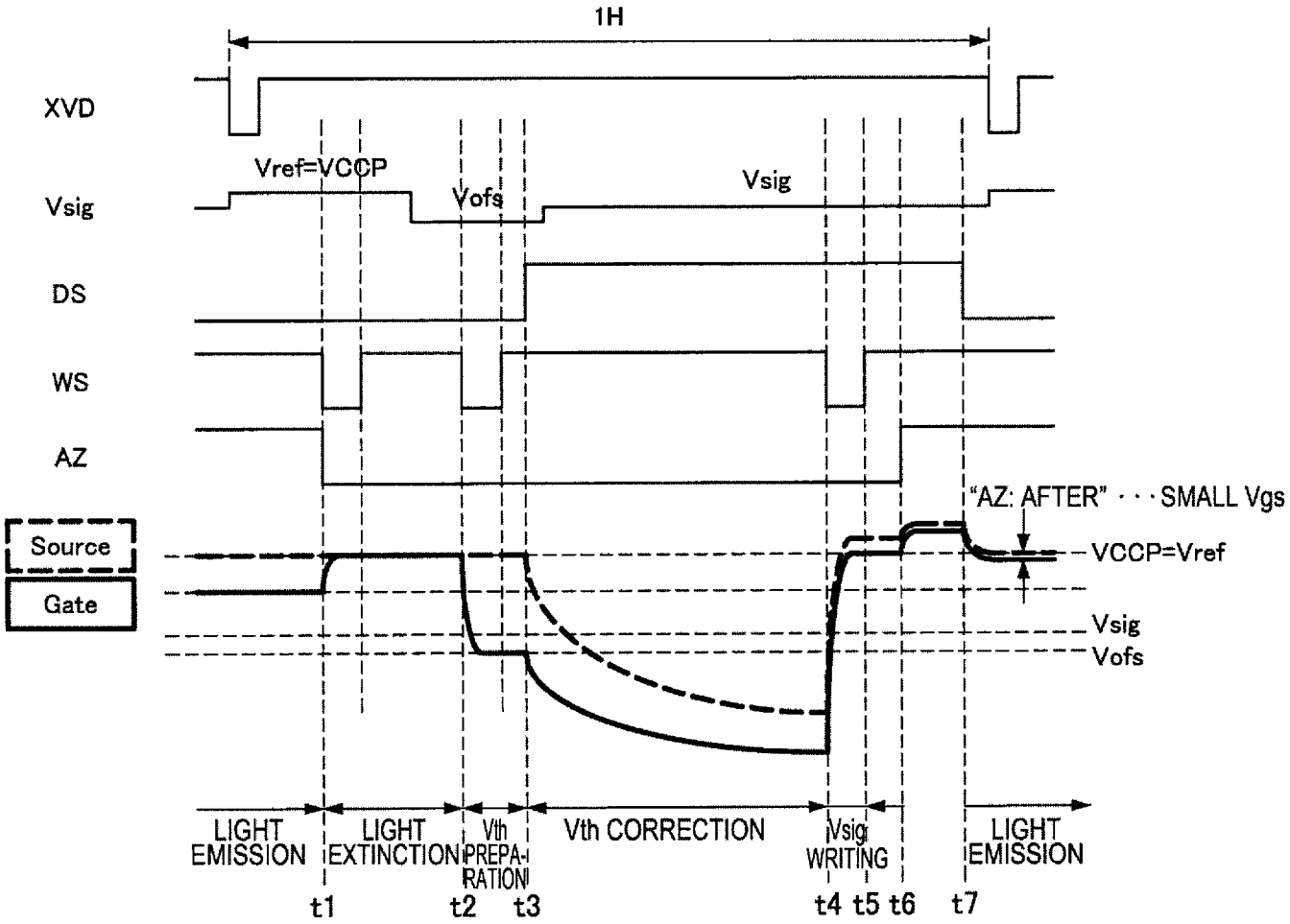

[Fig. 9]
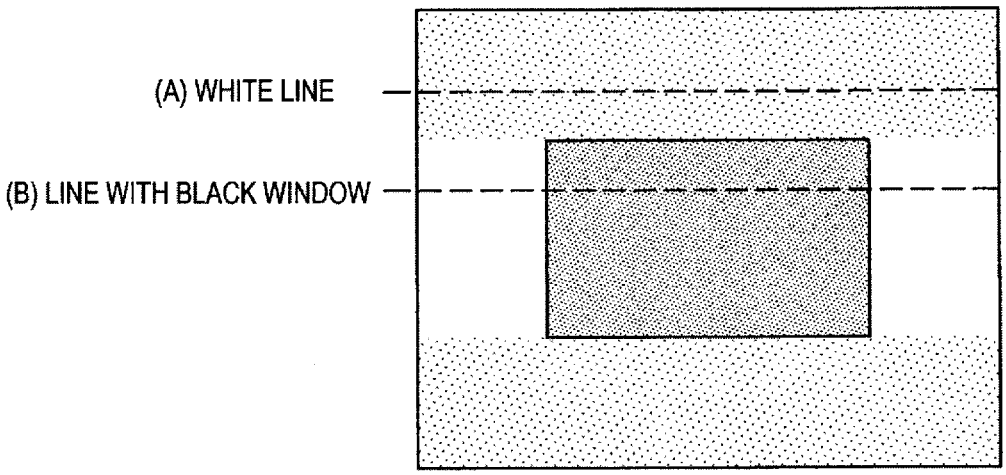
[Fig. 10]
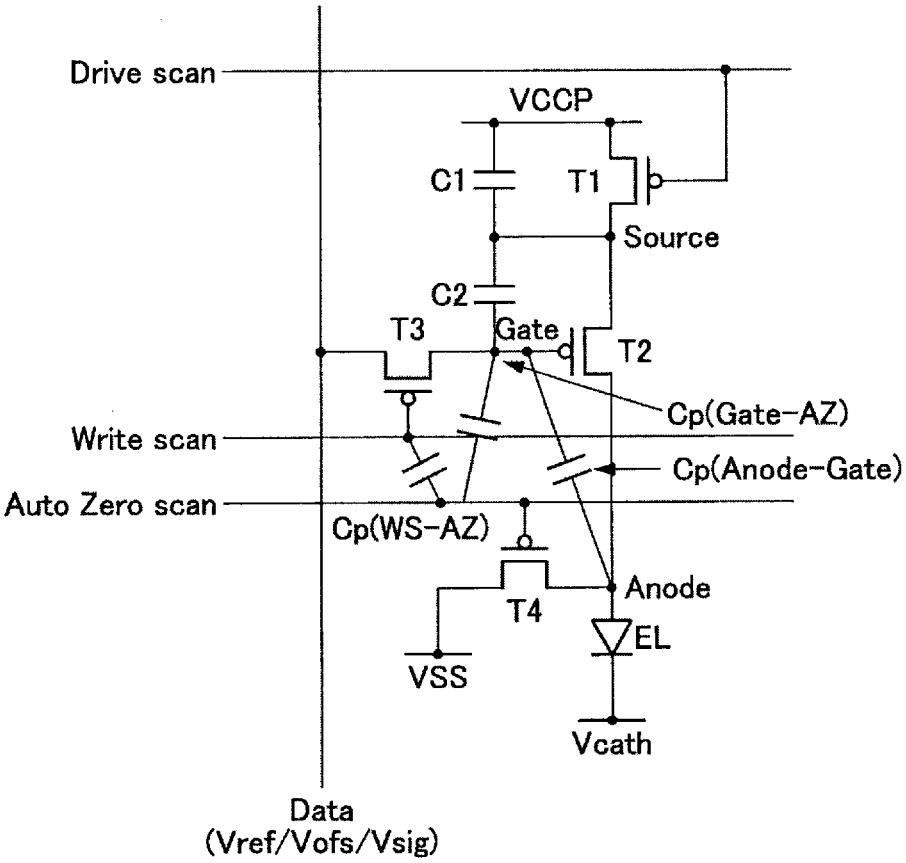

[Fig. 11]
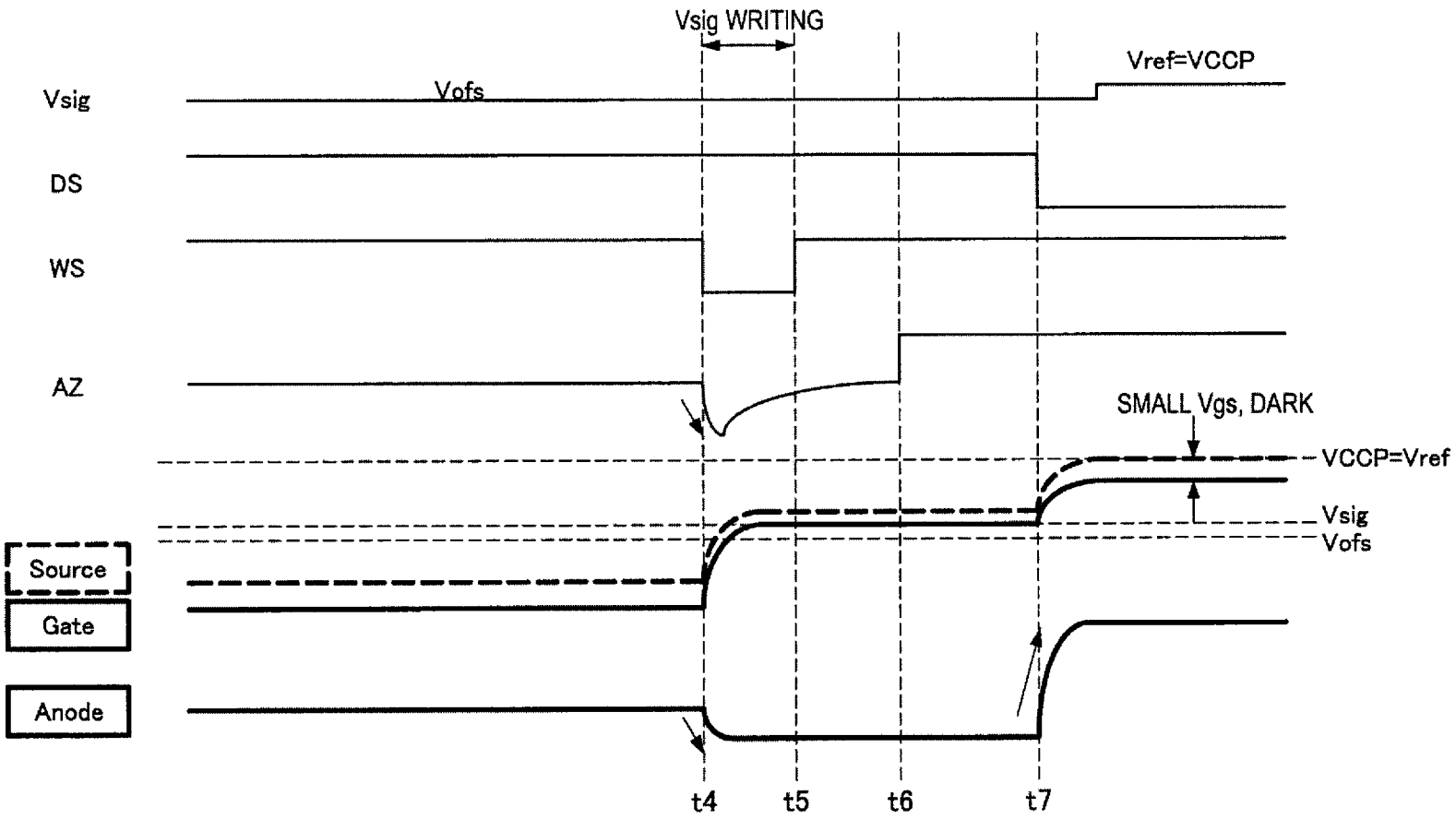

[Fig. 12]
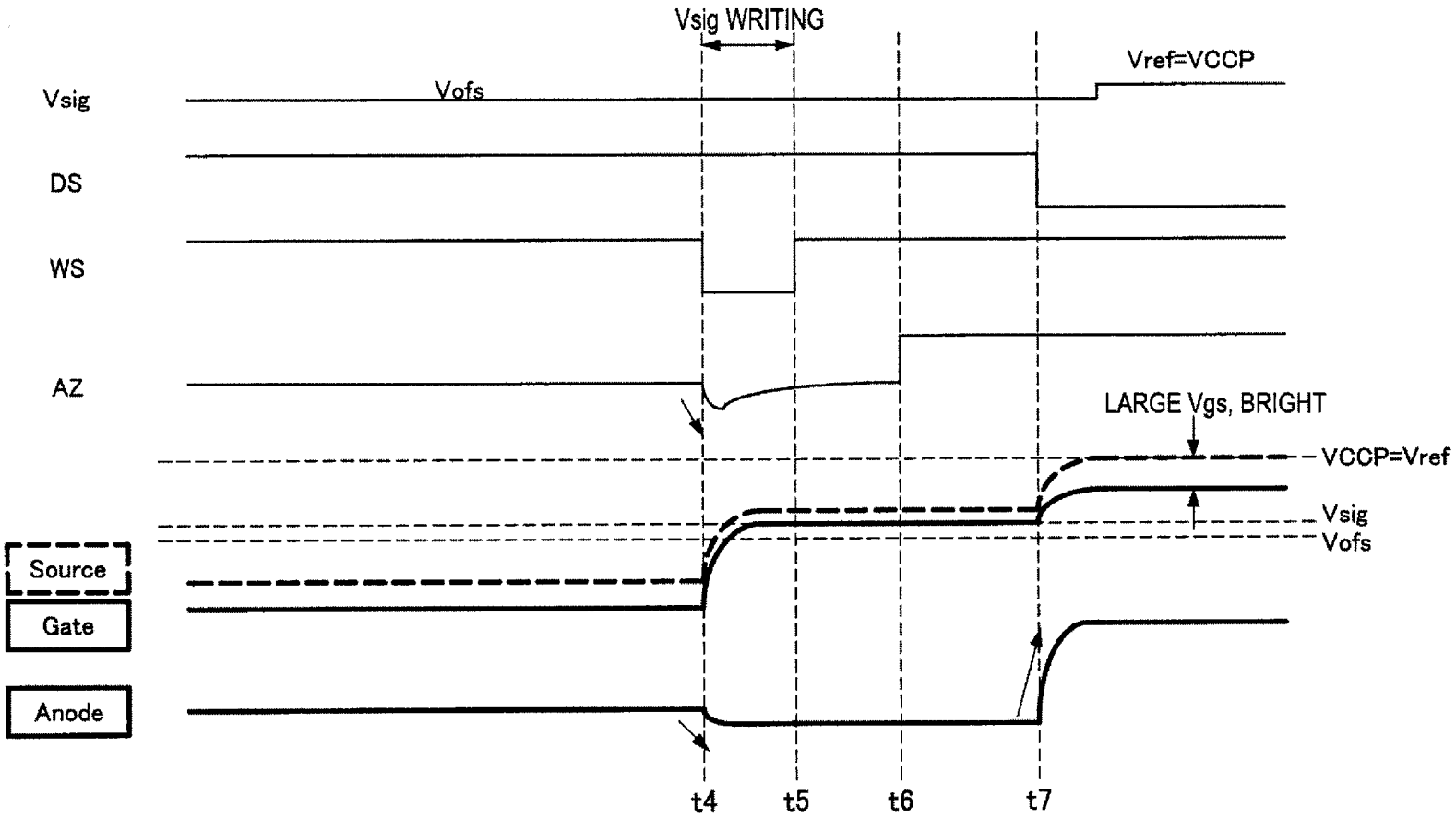

[Fig. 13]
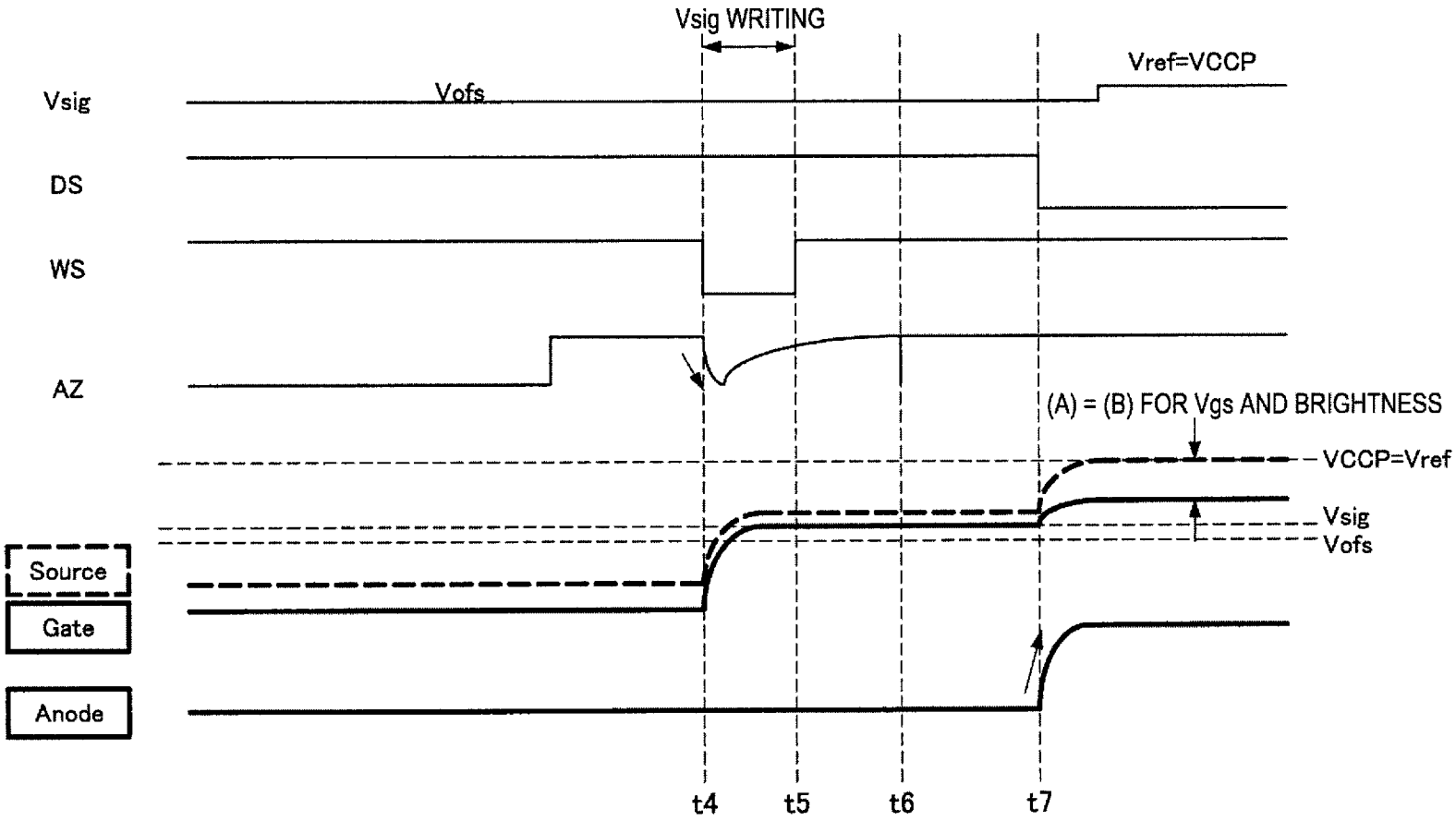

[Fig. 14]
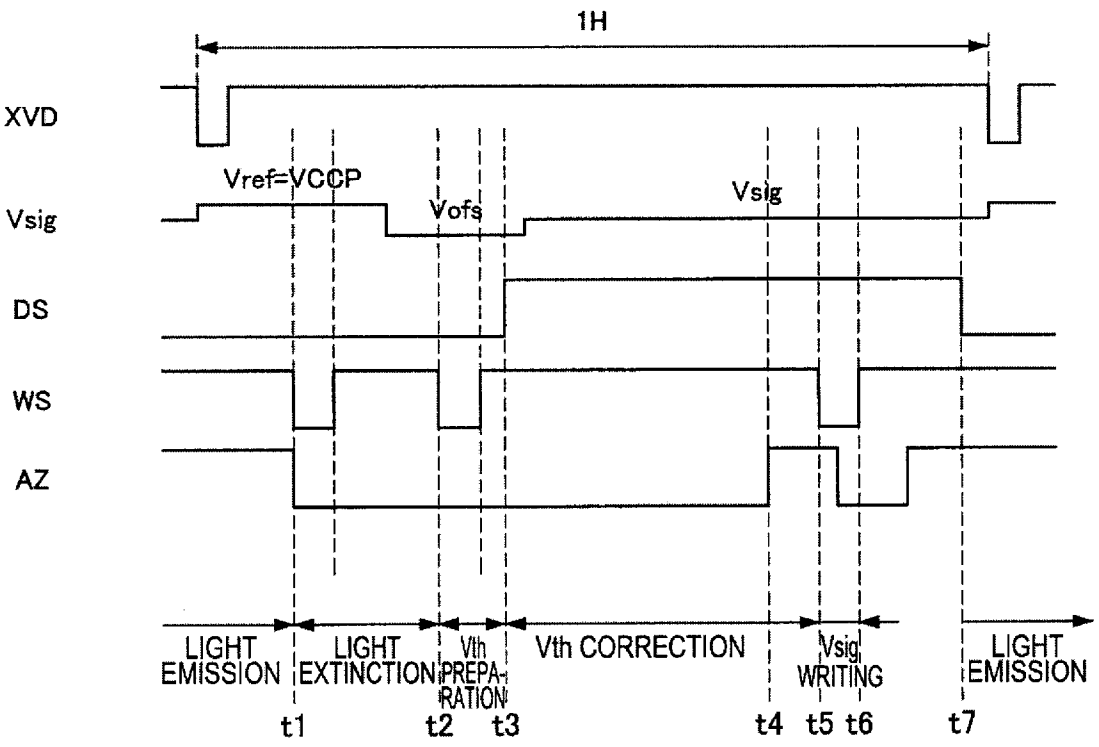

[Fig. 15]
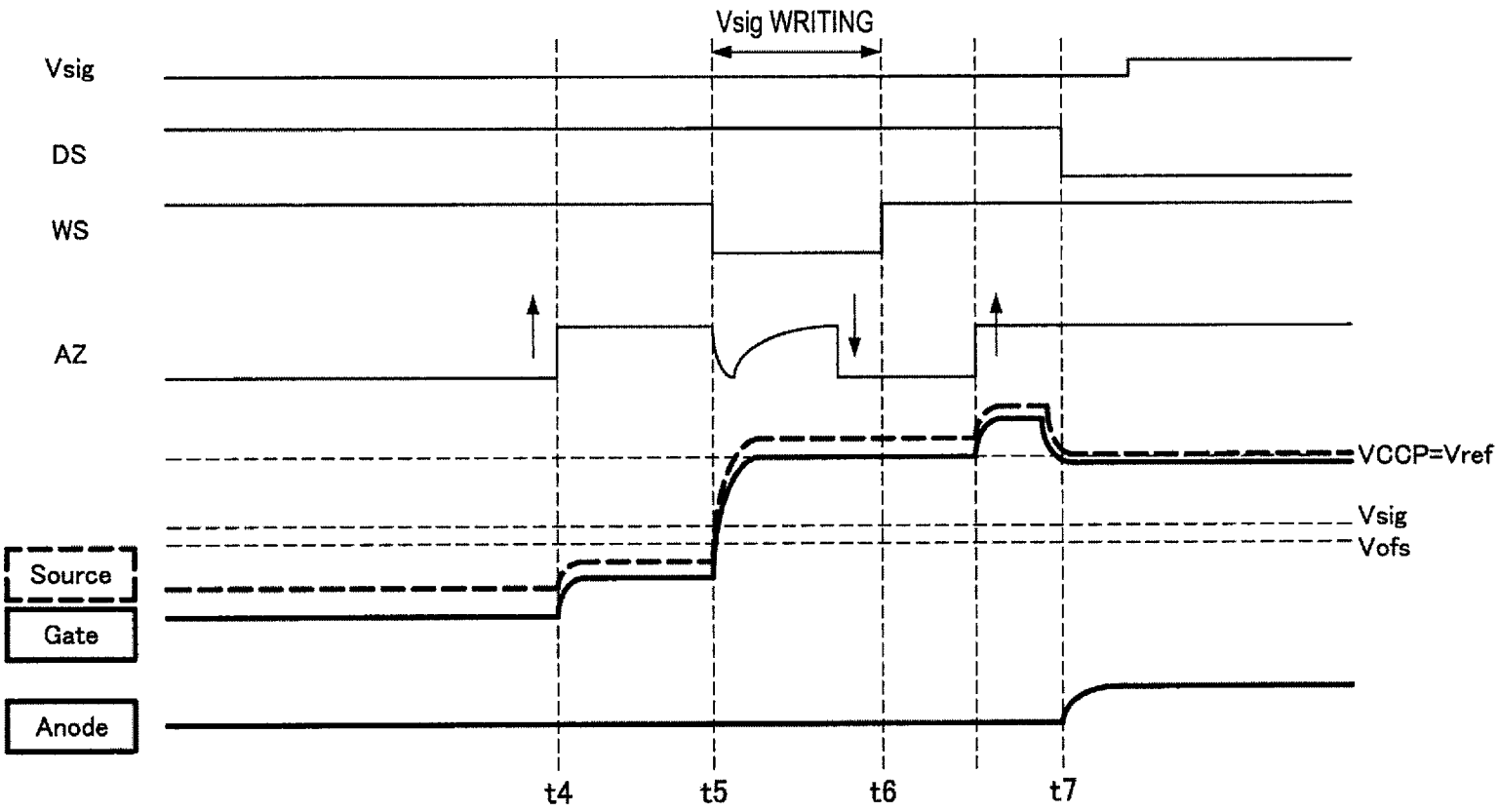

[Fig. 16]
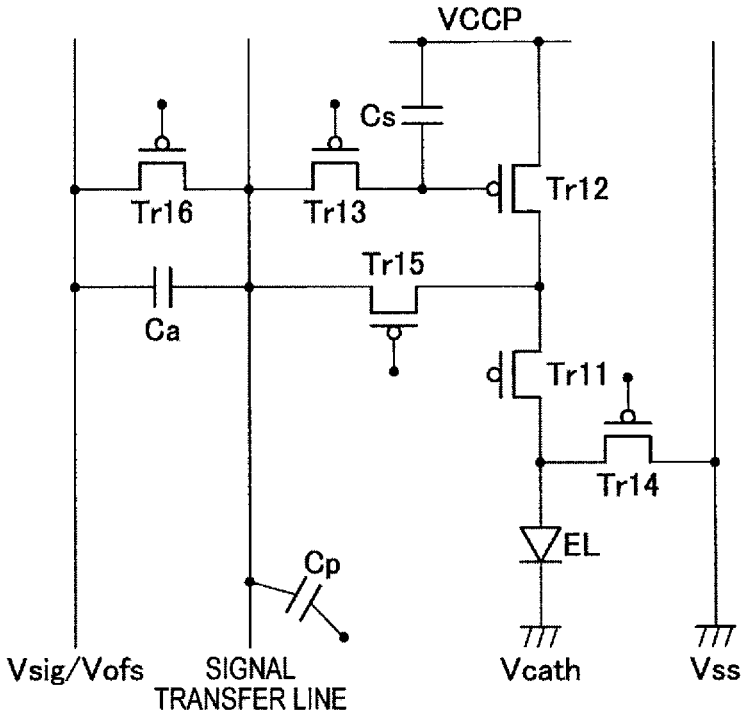

[Fig. 17]
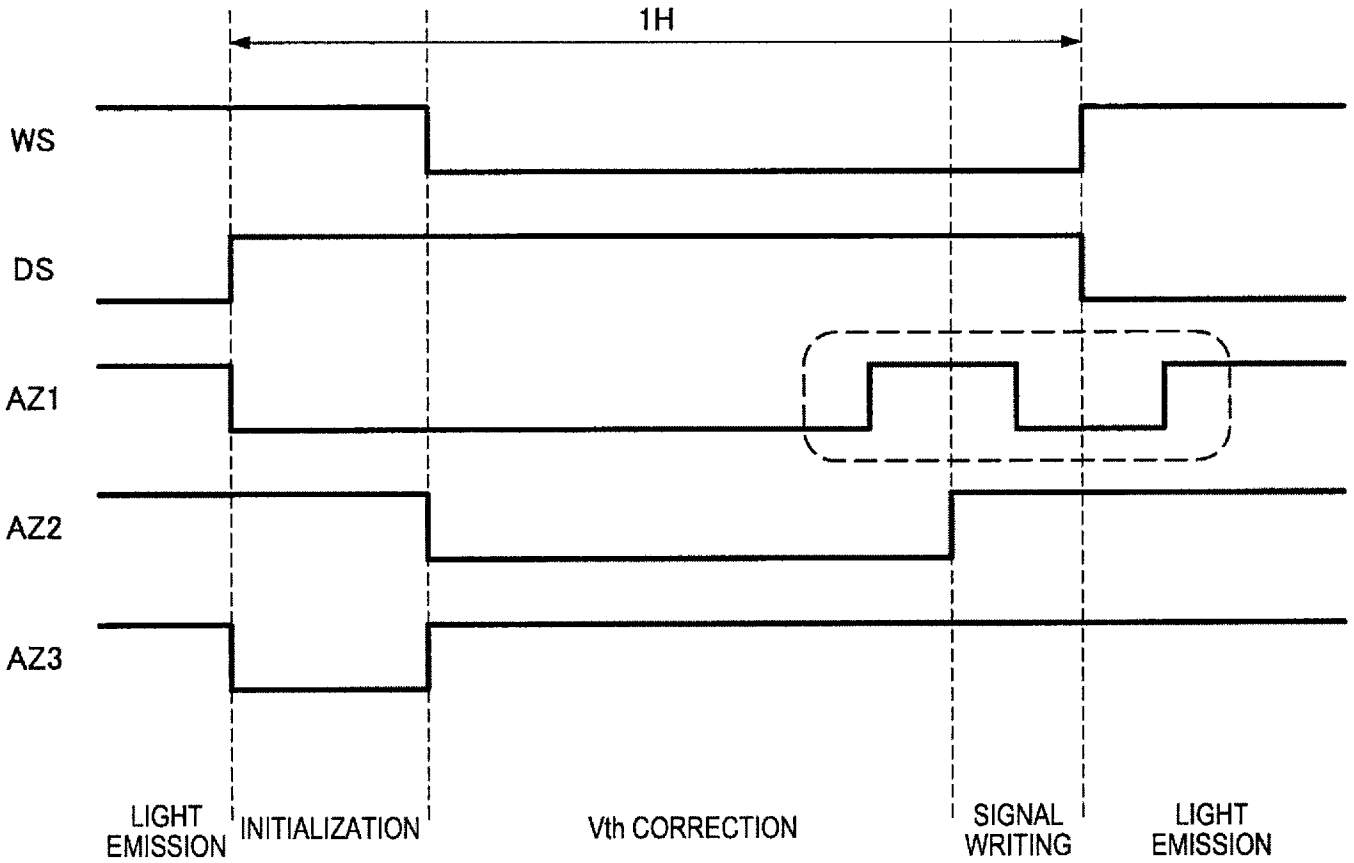

[Fig. 18]
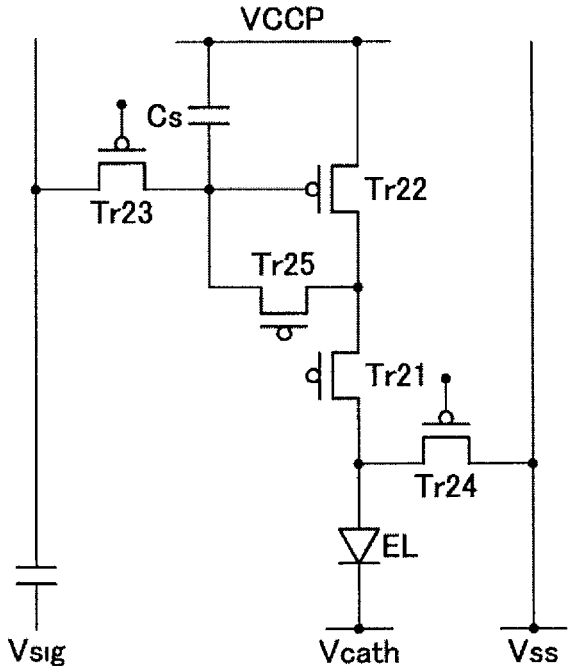

[Fig. 19]
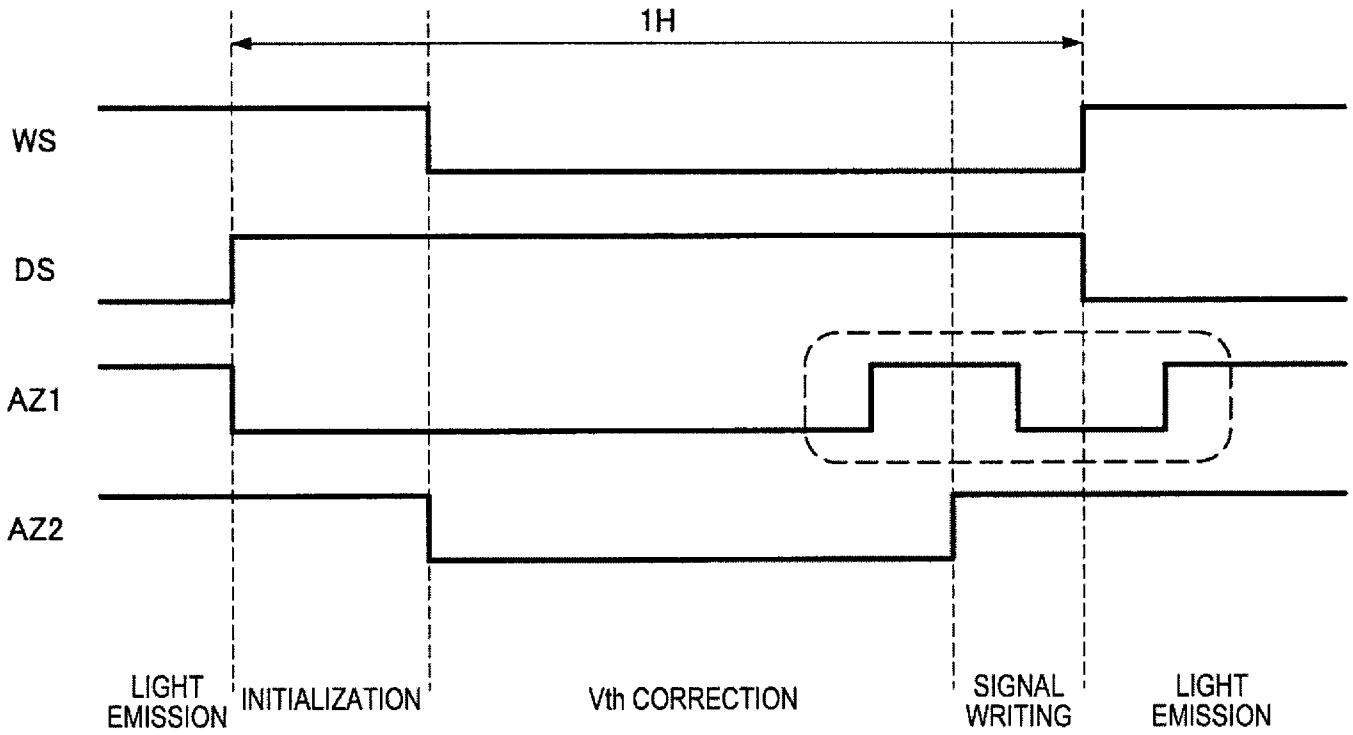

[Fig. 20]
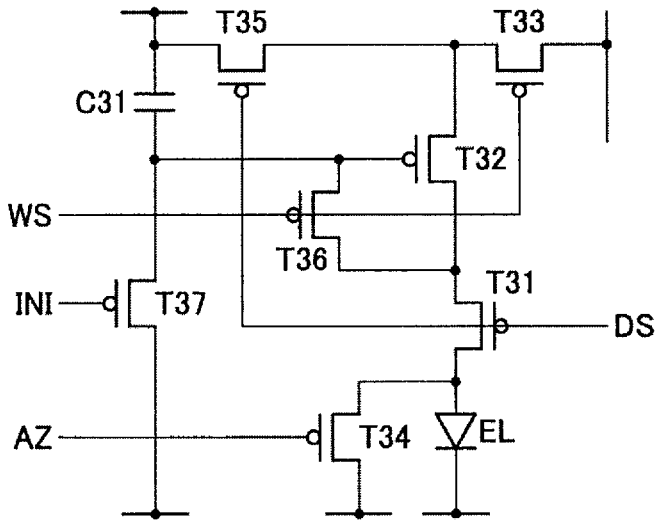
[Fig. 21]
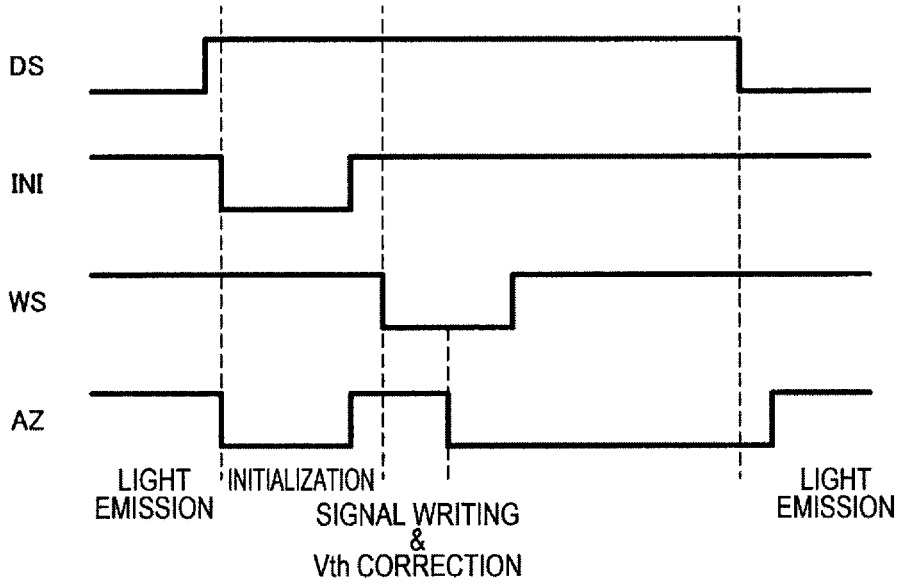

[Fig. 22]
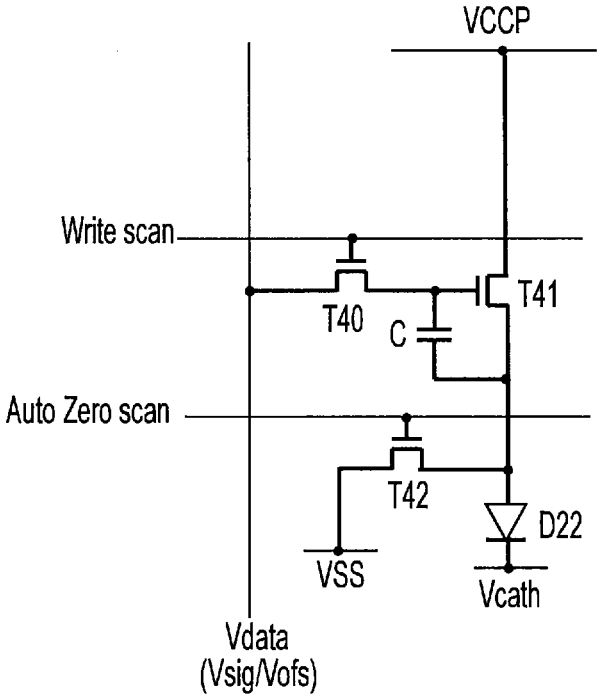
[Fig. 23]
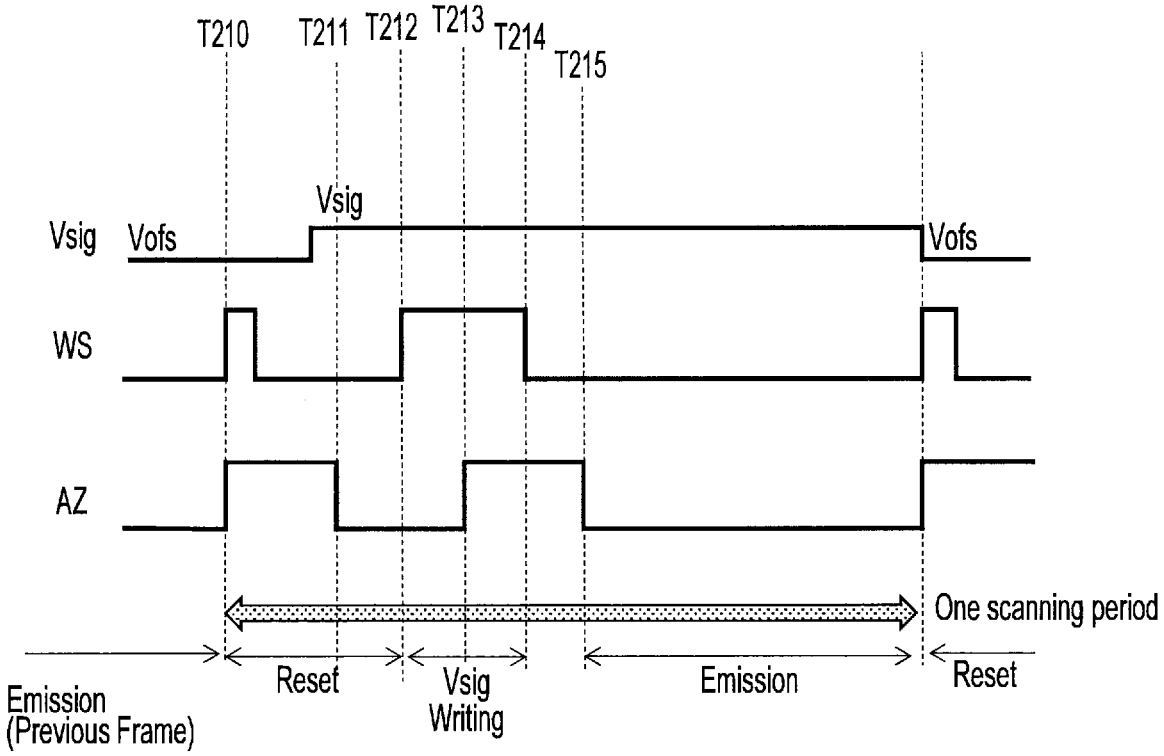

[Fig. 24]
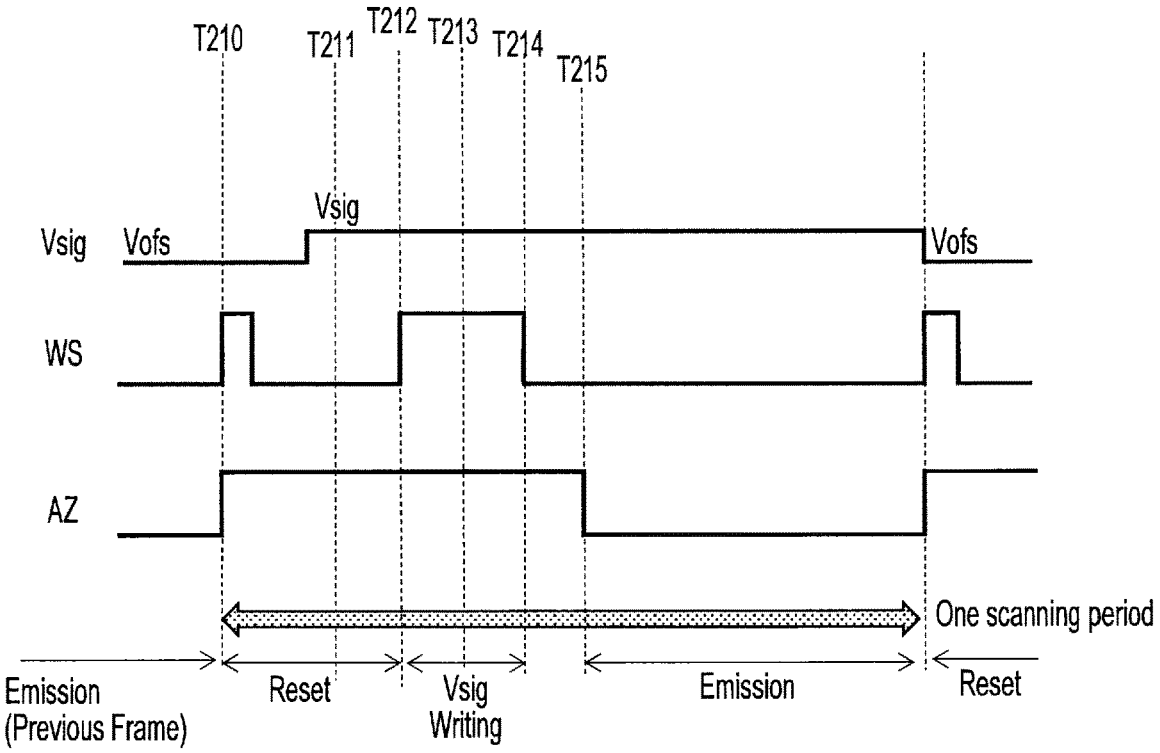
[Fig. 25]
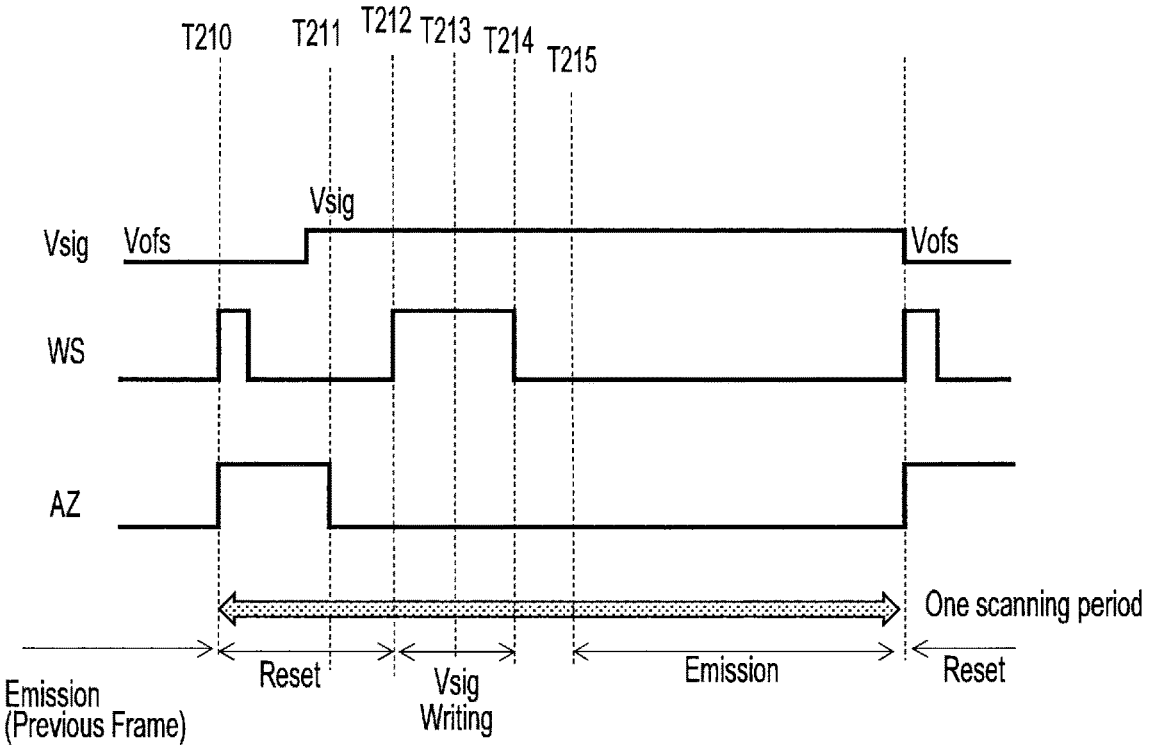

PIXEL CIRCUIT, DISPLAY DEVICE, METHOD FOR DRIVING PIXEL CIRCUIT, AND ELECTRONIC APPARATUS

CROSS REFERENCE TO RELATED APPLICATIONS

This application claims the benefit of Japanese Priority Patent Application JP 2017-209327 filed Oct. 30, 2017, the entire contents of which are incorporated herein by reference.

TECHNICAL FIELD

The present disclosure relates to a pixel circuit, a display device, a method for driving a pixel circuit, and an electronic apparatus.

BACKGROUND ART

In recent years, in the field of display devices, planar (flat-panel-type) display devices in which pixels each including a light-emitting section are arranged in a matrix have been mainly used. One of planar display devices is an organic EL display device using what is called a current-driven electro-optic element, for example, an organic electro luminescence (EL) element, whose emitted luminance changes depending on a current value that flows in the light-emitting section.

In planar display devices typified by the organic EL display device, transistor characteristics (e.g., a threshold voltage) of a driving transistor that drives an electro-optic element are caused to vary between pixels by fluctuation of a process or the like in some cases. For example, PTL 1 discloses a technology of a display device in which, in performing correction operation for characteristics of the driving transistor, write time of an initialization voltage to a gate node of the driving transistor can be shortened.

CITATION LIST

Patent Literature

PTL 1: JP 2015-34861A

SUMMARY

Technical Problem

In performing correction operation for characteristics of the driving transistor, when a signal is driven in order to improve contrast (luminance in black gradation), a phenomenon called horizontal crosstalk occurs, in which a luminance difference is caused in a white display portion, and when a signal is driven in order to improve horizontal crosstalk, contrast deteriorates conversely.

Hence, the present disclosure proposes a pixel circuit, a display device, a method for driving a pixel circuit, and an electronic apparatus that are novel and improved and capable of improving contrast and horizontal crosstalk at the same time. In addition, it is desirable to reduce power consumption within a pixel circuit.

Solution to Problem

According to an embodiment of the present disclosure, there is provided a pixel circuit including: a light-emitting element; a driving transistor whose source is connected to an anode of the light-emitting element; a sampling transistor, whose source is connected to a gate of the driving transistor, that samples a signal voltage to be written to the driving transistor; and a reset transistor that resets the anode of the light-emitting element to a predetermined potential at a predetermined timing. The reset transistor switches from on to off before the signal voltage is written to the driving transistor, switches from off to on while the signal voltage is being written to the driving transistor after the switching, and switches from on to off before a period in which the light-emitting element emits light after the writing.

In addition, according to an embodiment of the present disclosure, there is provided a display device including: a pixel array section in which pixel circuits, each of which is the above pixel circuit, are arranged; and a driving circuit that drives the pixel array section.

In addition, according to an embodiment of the present disclosure, there is provided an electronic apparatus including the above display device.

In addition, according to an embodiment of the present disclosure, there is provided a method for controlling a pixel circuit, the pixel circuit including a light-emitting element, a driving transistor whose source is connected to an anode of the light-emitting element, a sampling transistor, whose source is connected to a gate of the driving transistor, that samples a signal voltage to be written to the driving transistor, and a reset transistor that resets the anode of the light-emitting element to a predetermined potential at a predetermined timing, the method including: the reset transistor switching from on to off before the signal voltage is written to the driving transistor; the reset transistor switching from off to on while the signal voltage is being written to the driving transistor; and the reset transistor switching from on to off before a period in which the light-emitting element emits light after the writing.

Advantageous Effects of Invention

According to an embodiment of the present disclosure as described above, a pixel circuit, a display device, a method for driving a pixel circuit, and an electronic apparatus that are novel and improved and capable of improving contrast and horizontal crosstalk at the same time can be provided. Furthermore, in embodiments, power consumption is reduced by reducing the penetrative current that flows through the pixel circuit.

Note that the effects described above are not necessarily limitative. With or in the place of the above effects, there may be achieved any one of the effects described in this specification or other effects that may be grasped from this specification.

BRIEF DESCRIPTION OF DRAWINGS

FIG. 1 is an explanatory diagram illustrating a configuration example of a display device 100 according to an embodiment of the present disclosure.

FIG. 2 is an explanatory diagram illustrating a more detailed configuration example of the display device 100 according to the embodiment.

FIG. 3 is an explanatory diagram illustrating a more detailed configuration example of the display device 100 according to the embodiment.

FIG. 4 is an explanatory diagram illustrating the pixel circuit extracted from FIG. 3.

FIG. 5 is an explanatory diagram illustrating a comparative example of a method for driving the display device 100 according to the embodiment.

FIG. 6 is an explanatory diagram illustrating a comparative example of a method for driving the display device 100 according to the embodiment.

FIG. 7 is an explanatory diagram illustrating a comparative example of a method for driving the display device 100 according to the embodiment.

FIG. 8 is an explanatory diagram illustrating a comparative example of a method for driving the display device 100 according to the embodiment.

FIG. 9 is an explanatory diagram for describing horizontal crosstalk.

FIG. 10 is an explanatory diagram illustrating a pixel circuit used in considering horizontal crosstalk.

FIG. 11 is an explanatory diagram illustrating a comparative example of a method for driving the display device 100 according to the embodiment.

FIG. 12 is an explanatory diagram illustrating a comparative example of a method for driving the display device 100 according to the embodiment.

FIG. 13 is an explanatory diagram illustrating a comparative example of a method for driving the display device 100 according to the embodiment of the present disclosure.

FIG. 14 is an explanatory diagram illustrating a method for driving the display device 100 according to the embodiment.

FIG. 15 is an explanatory diagram illustrating a method for driving the display device 100 according to the embodiment.

FIG. 16 is an explanatory diagram illustrating a modification of a pixel circuit formed in a pixel section 110 of the display device 100 according to the embodiment.

FIG. 17 is an explanatory diagram illustrating progression of signals that drive the pixel circuit illustrated in FIG. 16.

FIG. 18 is an explanatory diagram illustrating a modification of a pixel circuit formed in the pixel section 110 of the display device 100 according to the embodiment.

FIG. 19 is an explanatory diagram illustrating progression of signals that drive the pixel circuit illustrated in FIG. 18.

FIG. 20 is an explanatory diagram illustrating a modification of a pixel circuit formed in the pixel section 110 of the display device 100 according to the embodiment.

FIG. 21 is an explanatory diagram illustrating progression of signals that drive the pixel circuit illustrated in FIG. 20.

FIG. 22 is an explanatory diagram illustrating a pixel circuit using N-type transistors according to embodiments of the disclosure.

FIG. 23 is an explanatory timing diagram according to embodiments of the disclosure for use with the pixel circuit of FIG. 22.

FIG. 24 is an example timing diagram for use with the circuit of FIG. 22.

FIG. 25 is another example timing diagram for the pixel circuit of FIG. 22.

DESCRIPTION OF EMBODIMENTS

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that description will be given in the following order.

1. Embodiment of present disclosure 1.1. Overall description about display device, method for driving display device, and electronic apparatus of present disclosure 1.2. Configuration example and operation example 1.3. Modifications 2. Conclusion

1. Embodiment of Present Disclosure

1.1. Overall Description about Display Device, Method for Driving Display Device, and Electronic Apparatus of Present Disclosure A display device of an embodiment of the present disclosure is a planar (flat-panel-type) display device in which pixel circuits each including a driving transistor that drives a light-emitting section, a sampling transistor, and holding capacitance are arranged. Examples of the planar display device include an organic EL display device, a liquid crystal display device, a plasma display device, and the like. Among these display devices, the organic EL display device utilizes electroluminescence of an organic material, and uses, as a light-emitting element (electro-optic element) of a pixel, an organic EL element using a phenomenon in which an organic thin film emits light when subjected to an electric field.

An organic EL display device using an organic EL element as a light-emitting section of a pixel has the following features. That is, since the organic EL element can be driven with an application voltage of 10 V or less, the organic EL display device has low power consumption. Since the organic EL element is a self-luminous element, the organic EL display device achieves higher image viewability and also is easily reduced in weight and thickness because it does not need a lighting member such as a backlight, as compared with a liquid crystal display device, which also is a planar display device. Furthermore, since response speed of the organic EL element is as very fast as approximately several microseconds, a residual image at the time of displaying a moving image does not occur in the organic EL display device.

An organic EL element is a self-luminous element, and also is a current-driven electro-optic element. Examples of current-driven electro-optic elements include, in addition to the organic EL element, an inorganic EL element, an LED element, a semiconductor laser element, and the like.

A planar display device such as an organic EL display device can be used as a display section (display device) of any of various electronic apparatuses including a display section. Examples of the various electronic apparatuses include a television system, a mobile information apparatus such as a head-mounted display, a digital camera, a video camera, a game console, a notebook personal computer, or an electronic book reader, a mobile communication apparatus such as a personal digital assistant (PDA) or a mobile phone, and the like.

In a display device, a method for driving a display device, and an electronic apparatus of an embodiment of the present disclosure, a driving section can be configured in a manner that a gate node of a driving transistor is brought into a floating state and then a source node is brought into a floating state. In addition, the driving section can be configured in a manner that signal voltage writing by a sampling transistor is performed while the source node of the driving transistor is kept in a floating state. An initialization voltage can be supplied to a signal line at a timing different from that of the signal voltage, and written to the gate node of the driving transistor from the signal line by sampling by the sampling transistor.

In the display device, the method for driving a display device, and the electronic apparatus of an embodiment of the present disclosure, including the preferable configuration described above, a pixel circuit can be configured to be formed on a semiconductor such as silicon. In addition, the driving transistor can include a P-channel transistor. A P-channel transistor rather than an N-channel transistor is used as the driving transistor for the following reasons.

In the case where a transistor is formed not on an insulator such as a glass substrate but on a semiconductor such as silicon, the transistor has four terminals of source/gate/drain/back gate (base), instead of three terminals of source/gate/drain. Then, in the case where an N-channel transistor is used as a driving transistor, a back gate (substrate) voltage is 0 V, which adversely affects an operation of correcting variation in threshold voltage of the driving transistor between pixels, or the like.

In addition, as compared with an N-channel transistor having lightly doped drain (LDD) regions, characteristic variation of a transistor is smaller in a P-channel transistor not having LDD regions, which is advantageous in making pixels finer and thereby achieving higher definition of a display device. According to such reasons, it is preferable to use a P-channel transistor rather than an N-channel transistor as the driving transistor in the case where formation on a semiconductor such as silicon is assumed.

In the display device, the method for driving a display device, and the electronic apparatus of an embodiment of the present disclosure, including the preferable configuration described above, also the sampling transistor can include a P-channel transistor.

Alternatively, in the display device, the method for driving a display device, and the electronic apparatus of an embodiment of the present disclosure, including the preferable configuration described above, the pixel circuit can include a light emission control transistor that controls light emission/non-light emission of a light-emitting section. In this case, also the light emission control transistor can include a P-channel transistor.

Alternatively, in the display device, the method for driving a display device, and the electronic apparatus of an embodiment of the present disclosure, including the preferable configuration described above, holding capacitance can be connected between the gate node and the source node of the driving transistor. In addition, the pixel circuit can include auxiliary capacitance connected between the source node of the driving transistor and a node of a fixed potential.

Alternatively, in the display device, the method for driving a display device, and the electronic apparatus of an embodiment of the present disclosure, including the preferable configuration described above, the pixel circuit can include a switching transistor connected between a drain node of the driving transistor and a cathode node of the light-emitting section. In this case, also the switching transistor can include a P-channel transistor. In addition, the driving section can be configured in a manner that the switching transistor is brought into a conduction state in a non-light-emission period of the light-emitting section.

Alternatively, in the display device, the method for driving a display device, and the electronic apparatus of an embodiment of the present disclosure, including the preferable configuration described above, the driving section can be configured in a manner that a signal for driving the switching transistor is brought into an active state before a sampling timing of an initialization voltage by the sampling transistor; then, after a signal for driving the light emission control transistor is brought into an active state, the signal for driving the switching transistor is brought into an inactive state. In this case, the driving section can be configured in a manner that sampling of the initialization voltage by the sampling transistor is completed before the signal for driving the light emission control transistor is brought into an inactive state.

1.2. Configuration Example and Operation Example

Now, a configuration example of a display device according to an embodiment of the present disclosure will be described. FIG. 1 is an explanatory diagram illustrating a configuration example of a display device 100 according to an embodiment of the present disclosure. A configuration example of the display device 100 according to the embodiment of the present disclosure is described below by using FIG. 1.

A pixel section 110 has a configuration in which pixels each provided with an organic EL element or another self-luminous element are arranged in a matrix. In the pixel section 110, scan lines are provided in a horizontal direction in units of lines, and signal lines are provided for respective columns to intersect the scan lines at right angles, for the pixels arranged in a matrix.

A horizontal selector 120 sequentially transfers a predetermined sampling pulse, and sequentially latches image data with this sampling pulse, thereby allocating the image data to the signal lines. In addition, the horizontal selector 120 performs analog-to-digital conversion processing on image data allocated to each signal line, thereby generating a driving signal indicating, by time division, emitted luminance of each of pixels connected to each signal line. The horizontal selector 120 outputs the driving signal to the corresponding signal line.

A vertical scanner 130 generates a driving signal for the pixels and outputs it to the scan lines SCN, in response to driving of the signal lines by the horizontal selector 120. Thus, the display device 100 sequentially drives the pixels arranged in the pixel section 110 by the vertical scanner 130, causes the pixels to emit light at signal levels of the respective signal lines set by the horizontal selector 120, and displays a desired image on the pixel section 110.

FIG. 2 is an explanatory diagram illustrating a more detailed configuration example of the display device 100 according to the embodiment of the present disclosure. A configuration example of the display device 100 according to the embodiment of the present disclosure is described below by using FIG. 2.

In the pixel section 110, pixels 111R that display red, pixels 111G that display green, and pixels 111B that display blue are arranged in a matrix.

The vertical scanner 130 includes an auto-zero scanner 131, a driving scanner 132, and a writing scanner 133. Signals are supplied from each scanner to the pixels arranged in a matrix in the pixel section 110; thus, on/off operations of TFTs provided in each pixel are performed.

FIG. 3 is an explanatory diagram illustrating a more detailed configuration example of the display device 100 according to the embodiment of the present disclosure. A configuration example of the display device 100 according to the embodiment of the present disclosure is described below by using FIG. 3.

FIG. 3 illustrates a pixel circuit for one of pixels arranged in a matrix in the pixel section 110. The pixel circuit includes transistors T1 to T4, capacitors C1 and C2, and an organic EL element EL. FIG. 4 is an explanatory diagram illustrating the pixel circuit extracted from FIG. 3.

The transistor T1 is a light emission control transistor that controls light emission of the organic EL element EL. The transistor T1 is connected between a power supply node of a power supply voltage VCCP and a source node (source electrode) of the transistor T2, and is driven by a light emission control signal output from the driving scanner 132 to control light emission/non-light emission of the organic EL element EL.

The transistor T2 is a driving transistor that drives the organic EL element EL by causing driving current corresponding to held voltage of the capacitor C2 to flow in the organic EL element EL.

The transistor T3 samples a signal voltage Vsig supplied from the writing scanner 133, thereby writing the signal voltage Vsig to a gate node (gate electrode) of the transistor T2.

The transistor T4 is a reset transistor connected between a drain node (drain electrode) of the transistor T2 and a current discharge destination node (e.g., a power supply VSS). The transistor T4 is driven by a driving signal from the auto-zero scanner 131 to perform control to prevent the organic EL element EL from emitting light in a non-light-emission period of the organic EL element EL. The transistors T1 to T4 can all include a P-channel transistor.

The capacitor C2 is connected between the gate node and the source node of the transistor T2, and holds the signal voltage Vsig written by sampling by the transistor T3. The capacitor C1 is connected between the source node of the transistor T2 and a node of a fixed potential (e.g., a power supply node of the power supply voltage VCCP). The capacitor C1 has a function of suppressing fluctuation of a source voltage of the transistor T2 when the signal voltage is written, and setting a gate-source voltage Vgs of the transistor T2 to a threshold voltage Vth of the transistor T2.

In this type of display device 100, the pixel section 110, the horizontal selector 120, the vertical scanner 130, and the like are collectively formed on a transparent insulating substrate including a glass substrate or the like by using polysilicon TFTs. There is a problem in that polysilicon TFTs inevitably involve variation in threshold voltage and mobility, and this variation causes image quality to deteriorate in a display device using an organic EL element.

Hence, it is possible to configure a pixel circuit with a circuit configuration illustrated in FIG. 4, for example, and correct variation in threshold voltage and mobility of a driving transistor.

In regard to a method for driving the display device 100 having the above configuration, first, description is given on a driving method according to a comparative example in a technology preceding the technology of an embodiment of the present disclosure (i.e., a driving method according to an embodiment).

FIG. 5 is an explanatory diagram illustrating a comparative example of a method for driving the display device 100 according to the embodiment of the present disclosure. FIG. 5 illustrates temporal progression of a horizontal synchronization signal XVD, a signal voltage Vsig, a signal DS from the driving scanner 132, a signal WS from the writing scanner 133, and a signal AZ from the auto-zero scanner 131. FIG. 5 also illustrates temporal progression of a source potential Source and a gate potential Gate of the transistor T2, and an anode potential Anode of the organic EL element EL.

At time t1, the signals WS and AZ change from high to low, and a light emission period ends. AZ is caused to transition from high to low in order to prevent current from flowing into the organic EL element EL and the organic EL element EL from emitting light during a Vth correction period described later. In addition, the signal AZ becomes low in order to turn on the transistor T4 in order to improve contrast in the Vth correction period described later. In time from time t1 to time t2, the signal WS becomes high again, and the signal voltage Vsig decreases to a predetermined voltage Vofs. At time t2, the signal WS becomes low, and a preparation period for correction of a threshold voltage of the transistor T2 starts. Here, the gate potential of the transistor T2 decreases to Vofs.

At time t3, the signal DS becomes high, so that the Vth correction period starts. In the Vth correction period, the gate-source voltage Vgs of the transistor T2 is set to a threshold voltage Vth of the transistor T2. In addition, at time t4 during the Vth correction period, the signal AZ changes from low to high.

After that, at time t5, the signal WS changes from high to low, and a writing period of the signal voltage Vsig to the transistor T2 starts. In this writing period, the gate potential of the transistor T2 becomes Vsig. At time t6, the signal WS changes from low to high, and the writing period of the signal voltage Vsig to the transistor T2 ends. Then, at time t7, the signal DS becomes low, and the transistor T1 is turned on; thus, the light emission period in which the organic EL element EL emits light starts. In the light emission period, the source potential of the transistor T2 becomes the power supply voltage VCCP.

FIG. 6 is an explanatory diagram illustrating a comparative example of a method for driving the display device 100 according to the embodiment of the present disclosure. FIG. 6 illustrates temporal progression of a horizontal synchronization signal XVD, a signal voltage Vsig, a signal DS from the driving scanner 132, a signal WS from the writing scanner 133, and a signal AZ from the auto-zero scanner 131. FIG. 6 also illustrates temporal progression of a source potential Source and a gate potential Gate of the transistor T2, and an anode potential Anode of the organic EL element EL.

As compared with the driving method illustrated in FIG. 5, in the driving method illustrated in FIG. 6, a timing at which the signal AZ changes from low to high is not the Vth correction period, but after the signal voltage Vsig writing period. That is, at time t4, the signal WS changes from high to low, and a writing period of the signal voltage Vsig to the transistor T2 starts, and at time t5, the signal WS changes from low to high, and the writing period of the signal voltage Vsig to the transistor T2 ends, and then at time t6, the signal AZ changes from low to high.

Thus, a difference in the timing at which the signal AZ changes from low to high does not have an influence on Vth correction or writing of a video signal. However, it has been found that a difference in the timing at which the signal AZ changes from low to high causes contrast to deteriorate, and causes a horizontal crosstalk phenomenon. Specifically, when the signal AZ is changed from low to high in the Vth correction period as illustrated in FIG. 5, contrast deteriorates, in other words, black luminance increases, whereas the horizontal crosstalk phenomenon is improved. On the other hand, when the signal AZ is changed from low to high after the signal voltage Vsig writing period as illustrated in FIG. 6, horizontal crosstalk deteriorates, whereas contrast is improved. A reason why such a phenomenon occurs will be described.

After Vth correction, when a video signal is written, a signal voltage Vsig corresponding to a black potential is written to the gate node of the transistor T2. Vg'=VCCP, where Vg' is a potential of the gate node after the video signal is written after Vth correction, and VCCP is the signal voltage Vsig corresponding to the black potential. Here, potential fluctuation ΔVg of the gate node of the transistor T2 is expressed by $$\Delta Vg = Vg' - Vg = VCCP - Vg,$$

where Vg is a potential of the gate node before the video signal is written after Vth correction.

On the other hand, potential fluctuation ΔVs of the source node of the transistor T2 connected via the capacitor C2 is expressed by $$\Delta Vs = \Delta Vg * Cs/(Cs + Csub + Cp_s) = (VCCP - Vg) * Cs/(Cs + Csub + Cp_s) \quad \text{(Formula 1)},$$

where Csub is capacitance of the capacitor C1, Cs is capacitance of the capacitor C2, and Cp_s is parasitic capacitance generated in the source node of the transistor T2 when the transistor T1 is off.

Here, Cs/(Cs+Csub+Cp_s)<1; hence, the potential fluctuation ΔVs of the source node of the transistor T2 is smaller than the potential fluctuation ΔVg of the gate node. That is, while the gate node of the transistor T2 rises to the voltage VCCP, the gate-source voltage Vgs of the transistor T2 becomes smaller.

Now, correlation between Vg' and a gate-source potential of the transistor T2 will be considered. The gate node, the source node, and the gate-source potential of the transistor T2 before the video signal is written after Vth correction are respectively denoted by Vg, Vs, and Vgs, and the gate node, the source node, and the gate-source potential of the transistor T2 after the video signal is written are respectively denoted by Vg', Vs', and Vgs'. Here, Vgs=Vs−Vg and Vgs'=Vs'−Vg'. In addition, the source node potential Vs' of the transistor T2 after the video signal is written is $$Vs' = Vs + (Vg' - Vg) * (Cs/(Cs + Csub + Cp_s)).$$

Here, when (Cs/(Cs+Csub+Cp_s))=(X), $$Vgs' = Vs + (Vg' - Vg) * (X) - Vg' = Vs - ((1 - X)Vg' + Vg(X)) \quad \text{(Formula 2)}.$$

When Vgs and Vgs' are compared, Vgs>Vgs' according to Vg<Vg'. In addition, as Vg' is larger, in other words, as the potential of the gate node after the video signal is written is higher, the gate-source potential Vgs' of the transistor T2 is smaller.

In the light of the above description, correlation between driving of the display device 100 and contrast will be described. First, a case where the signal AZ is changed from low to high in the Vth correction period is described. FIG. 7 is an explanatory diagram illustrating a comparative example of a method for driving the display device 100 according to the embodiment of the present disclosure. FIG. 7 illustrates an example of the case where the signal AZ is changed from low to high in the Vth correction period.

After Vth correction, the signal AZ transitions from low to high before Vsig is written; at this time, fluctuation of the signal AZ enters the gate node of the transistor T2 via parasitic capacitance Cp(Gate-AZ) existing between a signal line (AZ gate line) from the auto-zero scanner 131 and the gate node of the transistor T2. Potential fluctuation ΔVg(AZ) of the gate potential of the transistor T2 due to fluctuation of the signal AZ is expressed by $$\Delta Vg(AZ) = \Delta V(AZ) * Cp(\text{Gate}-AZ)/(Cp(\text{Gate}-AZ) + ((1/Cs) + (1/Csub)) + Cp_g) \quad \text{(Formula 3)}.$$

Here, ΔV(AZ) is a variable amplitude of the signal AZ, and Cp_g is parasitic capacitance generated in the gate node of the transistor T2 when the transistor T3 is off.

After that, a black signal is written to the gate node of the transistor T2, and the potential of the gate node of the transistor T2 rises to VCCP.

FIG. 8 is an explanatory diagram illustrating a comparative example of a method for driving the display device 100 according to the embodiment of the present disclosure. FIG. 8 illustrates an example of the case where the signal AZ is changed from low to high after Vsig is written. In this case, after the black signal is written to the gate node of the transistor T2 and the potential of the gate node of the transistor T2 changes to VCCP, an AZ pulse becomes high; thus, the potential of the gate node of the transistor T2 further rises. It is shown that in this case, a potential reached by the gate node of the transistor T2 is higher than in the case where the signal AZ is changed from low to high in the Vth correction period.

According to Formula 2, as the potential reached by the gate node of the transistor T2 is higher, the gate-source voltage Vgs of the transistor T2 is smaller. That is, the gate-source voltage Vgs of the transistor T2 is smaller and black luminance is lower in the case where the signal AZ is changed from low to high after Vsig is written, as compared with the case where the signal AZ is changed from low to high in the Vth correction period. That is, contrast is more improved in the case where the signal AZ is changed from low to high after Vsig is written.

Next, horizontal crosstalk is considered. FIG. 9 is an explanatory diagram for describing horizontal crosstalk. There is no problem in the case of displaying a white line in a dark place as with a line (A) in FIG. 9, whereas when video such as a black window is displayed in a white background as with a line (B), a luminance difference occurs in a white background portion. This phenomenon is horizontal crosstalk.

In addition, FIG. 10 is an explanatory diagram illustrating a pixel circuit used in considering horizontal crosstalk, and illustrates parasitic capacitance caused between signal lines and nodes.

FIGS. 11 and 12 are explanatory diagrams each illustrating a comparative example of a method for driving the display device 100 according to the embodiment of the present disclosure. FIGS. 11 and 12 each illustrate an example of the case where the signal AZ is changed from low to high after the Vth correction period. In addition, FIG. 11 illustrates a change in potential of the gate node and the source node of the transistor T2 and the anode node of the organic EL element EL in a region of the line (A) illustrated in FIG. 9. FIG. 12 illustrates a change in potential of the gate node and the source node of the transistor T2 and the anode node of the organic EL element EL in a region of the line (B) illustrated in FIG. 9.

A potential of the AZ gate line is in a low state before the signal WS is written to the gate node. When the signal WS transitions from high to low at the timing of video signal writing, negative coupling enters the AZ gate line via parasitic capacitance Cp(WS-AZ) generated between a signal line (WS gate line) from the writing scanner 133 and the AZ gate line, and the potential of the signal AZ decreases.

On the other hand, at the time of video signal writing, the potential of the gate node of the transistor T2 transitions to Vsig. This fluctuation of the gate node causes positive coupling to enter the AZ gate line via parasitic capacitance Cp(Gate-AZ) generated between the gate node and the AZ gate line. An amount of this coupling changes depending on the video signal as a matter of course, but an amount of voltage rise is larger in the line (B) illustrated in FIG. 9 than in the line (A). That is, a decrease in the potential of the AZ gate line is smaller in the line (B) because the negative coupling from the WS gate line is made up for.

That is, a rise in the potential of the gate node of the transistor T2 at the time of signal writing is small in the line (A); thus, a decrease in the potential of the AZ gate line is large. On the other hand, a rise in the potential of the gate node of the transistor T2 at the time of signal writing is large in the line (B); thus, a decrease in the potential of the AZ gate line is small.

A decrease in the potential of the AZ gate line causes an operation point of the transistor T4 to decrease, and the potential of the anode node of the organic EL element EL also decreases. Since the transistor T4 is a P-channel transistor, the anode potential of the organic EL element EL when the transistor T4 is on is the sum of a potential of the AZ gate line at which the transistor T4 is turned on and a threshold voltage of the transistor T4. That is, when the potential of the AZ gate line when the transistor T4 is on decreases, the anode potential of the organic EL element EL decreases correspondingly.

Thus, since a decrease in the potential of the AZ gate line is larger in the line (A) than in the line (B), the anode potential of the organic EL element EL decreases more in the line (A) than in the line (B).

After that, at the start of light emission, the anode potential of the organic EL element EL rises to a light emission potential of the organic EL element EL. This fluctuation of the anode potential applies positive coupling to Gate via parasitic capacitance Cp(Gate-Anode) generated between the gate node of the transistor T2 and the anode of the organic EL element EL, and the potential of the gate node of the transistor T2 rises. At this time, the gate-source voltage Vgs of the transistor T2 becomes smaller. An amount of this rise in anode potential is larger in the white line (A) in which the anode potential is lower before light emission. That is, the gate-source voltage Vgs of the transistor T2 is smaller in the white line (A) than in the black line (B), which cause crosstalk.

FIG. 13 is an explanatory diagram illustrating a comparative example of a method for driving the display device 100 according to the embodiment of the present disclosure. FIG. 13 illustrates an example of the case where the signal AZ is changed from low to high in the Vth correction period. In addition, FIG. 13 illustrates a change in potential of the gate node and the source node of the transistor T2 and the anode node of the organic EL element EL in a region of the line (A) illustrated in FIG. 9.

In the case where the signal AZ is changed from low to high in the Vth correction period, the mechanism is similar to that described using FIGS. 11 and 12 up to fluctuation of the AZ gate line. However, in the case where the signal AZ is changed from low to high in the Vth correction period, since the signal WS changes from high to low after that, the transistor T4 is in an off state and therefore does not have an influence on an operation point of the anode node of the organic EL element EL. Therefore, in the case where the signal AZ is changed from low to high in the Vth correction period, the potential of the anode node does not change between the line (A) and the line (B), and also at the time of light emission after that, no difference between the line (A) and the line (B) occurs in the gate-source voltage Vgs of the transistor T2. Therefore, in the case where the signal AZ is changed from low to high in the Vth correction period, horizontal crosstalk does not occur.

As described above, a difference in the timing at which the signal AZ changes from low to high causes contrast to deteriorate, and causes a horizontal crosstalk phenomenon. Hence, the display device 100 according to the present embodiment changes a transition timing of the signal AZ, thereby achieving both an improvement in contrast and suppression of horizontal crosstalk.

FIG. 14 is an explanatory diagram illustrating a method for driving the display device 100 according to the embodiment of the present disclosure. FIG. 14 illustrates temporal progression of a horizontal synchronization signal XVD, a signal voltage Vsig, a signal DS from the driving scanner 132, a signal WS from the writing scanner 133, and a signal AZ from the auto-zero scanner 131.

The display device 100 according to the embodiment of the present disclosure has the following feature: in the temporal progression of the signals illustrated in FIG. 14, the signal AZ transitions from low to high twice, i.e., during the Vth correction period and after the video signal writing period. That is, after transitioning from low to high during the Vth correction period, the signal AZ returns from high to low during the video signal writing period. Then, the signal AZ transitions from low to high again after the video signal writing period. By causing the signal AZ to transition in this manner, the display device 100 according to the embodiment of the present disclosure can achieve both an improvement in contrast and suppression of horizontal crosstalk. The principle of this will be described.

FIG. 15 is an explanatory diagram illustrating a method for driving the display device 100 according to the embodiment of the present disclosure. FIG. 15 illustrates temporal progression of a horizontal synchronization signal XVD, a signal voltage Vsig, a signal DS from the driving scanner 132, a signal WS from the writing scanner 133, and a signal AZ from the auto-zero scanner 131. In addition, FIG. 15 illustrates a change in potential of the gate node and the source node of the transistor T2 and the anode node of the organic EL element EL in a region of the line (A) illustrated in FIG. 9.

The display device 100 according to the embodiment of the present disclosure causes the signal AZ to transition from low to high during the Vth correction period. Thus, as described above, even when the signal WS changes from high to low at the time of video signal writing, the transistor T4 is in an off state and therefore does not have an influence on an operation point of the anode node of the organic EL element EL.

Then, the display device 100 according to the embodiment of the present disclosure causes the signal AZ to transition from high to low during the video signal writing period. At this timing, the gate node of the transistor T2 is grounded at a video signal voltage, and does not have an influence on an operation point of the transistor T2.

Then, the display device 100 according to the embodiment of the present disclosure causes the signal AZ to transition from low to high before the light emission period after the video signal writing period ends. Thus, as described above, a video signal is written to the gate node of the transistor T2. It has been described above that after the gate node of the transistor T2 changes to the voltage VCCP, transition of the signal AZ from low to high causes the gate node of the transistor T2 to further rise. As a potential reached by the gate node of the transistor T2 is higher, the gate-source voltage Vgs of the transistor T2 is smaller;

hence, causing the signal AZ to transition in this manner enables contrast to be improved.

1.3. Modifications

The technology according to an embodiment of the present disclosure can be similarly applied to any pixel circuit having a configuration in which a P-channel transistor for light extinction is connected to an anode of a self-luminous element.

FIG. 16 is an explanatory diagram illustrating a modification of a pixel circuit formed in the pixel section 110 of the display device 100 according to the embodiment of the present disclosure. The pixel circuit illustrated in FIG. 16 includes transistors T11 to T16, capacitors (parasitic capacitances) Cs, Ca, and Cp, and the organic EL element EL.

FIG. 17 is an explanatory diagram illustrating progression of signals that drive the pixel circuit illustrated in FIG. 16. WS denotes a signal supplied to a gate of the transistor T13, DS denotes a signal supplied to a gate of the transistor T11, AZ1 denotes a signal supplied to a gate of the transistor T14, AZ2 denotes a signal supplied to a gate of the transistor T15, and AZ3 denotes a signal supplied to a gate of the transistor T16.

Like the transistor T4 illustrated in FIG. 4 and the like, the transistor T14 performs control to prevent the organic EL element EL from emitting light in a nonlight-emission period of the organic EL element EL. Therefore, controlling a timing at which the transistor T14 is driven provides two effects of an improvement in contrast and prevention of horizontal crosstalk.

That is, as illustrated in FIG. 17, the transistor T14 is turned off once by changing the signal AZ1 from low to high in the Vth correction period, the transistor T14 is turned on by changing the signal AZ1 from high to low in the signal writing period, and the transistor T14 is turned off by changing the signal AZ1 from low to high after the signal writing period. By controlling the signal AZ1 in this manner, the display device 100 according to the embodiment of the present disclosure provides two effects of an improvement in contrast and prevention of horizontal crosstalk even in the case where the configuration illustrated in FIG. 16 is employed as a pixel circuit.

FIG. 18 is an explanatory diagram illustrating a modification of a pixel circuit formed in the pixel section 110 of the display device 100 according to the embodiment of the present disclosure. The pixel circuit illustrated in FIG. 18 includes transistors T21 to T25, a capacitor Cs, and the organic EL element EL.

FIG. 19 is an explanatory diagram illustrating progression of signals that drive the pixel circuit illustrated in FIG. 18. WS denotes a signal supplied to a gate of the transistor T23, DS denotes a signal supplied to a gate of the transistor T21, AZ1 denotes a signal supplied to a gate of the transistor T24, and AZ2 denotes a signal supplied to a gate of the transistor T25.

Like the transistor T4 illustrated in FIG. 4 and the like, the transistor T24 performs control to prevent the organic EL element EL from emitting light in a nonlight-emission period of the organic EL element EL. Therefore, controlling a timing at which the transistor T24 is driven provides two effects of an improvement in contrast and prevention of horizontal crosstalk.

That is, as illustrated in FIG. 19, the transistor T24 is turned off once by changing the signal AZ1 from low to high in the Vth correction period, the transistor T24 is turned on by changing the signal AZ1 from high to low in the signal writing period, and the transistor T24 is turned off by changing the signal AZ1 from low to high after the signal writing period. By controlling the signal AZ1 in this manner, the display device 100 according to the embodiment of the present disclosure provides two effects of an improvement in contrast and prevention of horizontal crosstalk even in the case where the configuration illustrated in FIG. 18 is employed as a pixel circuit.

FIG. 20 is an explanatory diagram illustrating a modification of a pixel circuit formed in the pixel section 110 of the display device 100 according to the embodiment of the present disclosure. The pixel circuit illustrated in FIG. 20 includes transistors T31 to T34, a capacitor C31, and the organic EL element EL. The transistor T31 is a light emission control transistor that controls light emission of the organic EL element EL. The transistor T32 is a driving transistor that drives the organic EL element EL by causing driving current corresponding to held voltage of the capacitor C31 to flow in the organic EL element EL. The transistor T33 samples a signal voltage Vsig supplied from the writing scanner 133. The transistor T34 is a reset transistor connected between a drain node (drain electrode) of the transistor T31 and a current discharge destination node. A signal line AZ is connected to a gate of the transistor T34. The transistors T31 to T34 can all include a P-channel transistor.

In addition, the pixel circuit illustrated in FIG. 20 includes transistors T35 to T37. A signal line DS is connected to a gate of the transistor T35 in a manner that on/off is switched at the same timing as the transistor T31. A signal line WS is connected to a gate of the transistor T36 in a manner that on/off is switched at the same timing as the transistor T33. The transistor T37 is an initialization transistor, and a signal line INI is connected to its gate. The transistors T35 to T37 can all include a P-channel transistor.

FIG. 21 is an explanatory diagram illustrating a timing chart of signals supplied to the pixel circuit illustrated in FIG. 20. The signal DS changes from low to high at the timing of completion of the light emission period, and the transistors T31 and T35 are turned off. In addition, the signal INI changes from high to low at the timing of completion of the light emission period, and the transistor T37 changes from off to on. In addition, the signal AZ changes from high to low at the timing of completion of the light emission period, and the transistor T34 changes from off to on.

During the following initialization period, the signal INI changes from low to high, and the transistor T37 changes from on to off. Also during the initialization period, the signal AZ changes from low to high, and the transistor T34 changes from on to off. The signal INI and the signal AZ switch at the same timing in FIG. 21, but the present disclosure is not limited to this example.

Then, at the timing of completion of the initialization period, the signal WS changes from high to low, and the transistors T33 and T36 change from off to on.

During the following signal writing and Vth correction period, first, the signal AZ changes from high to low, and the transistor T34 changes from off to on. After that, also during the signal writing and Vth correction period, the signal WS changes from low to high, and the transistors T33 and T36 change from on to off.

Then, at the timing of completion of the signal writing and Vth correction period, the signal DS changes from high to low, the transistors T31 and T35 change from off to on, and the organic EL element EL emits light. After that, in the light emission period, the signal AZ changes from low to high, and the transistor T34 changes from on to off.

That is, as illustrated in FIG. 21, the transistor T34 is turned on by changing the signal AZ from high to low in the signal writing and Vth correction period, and after that, the transistor T34 is turned off by changing the signal AZ from low to high. By controlling the signal AZ in this manner, the display device 100 according to the embodiment of the present disclosure provides two effects of an improvement in contrast and prevention of horizontal crosstalk even in the case where the configuration illustrated in FIG. 20 is employed as a pixel circuit.

Although the foregoing describes embodiments of the disclosure being preferentially applied to P-type transistors, the disclosure is not so limited. In fact, embodiments of the disclosure may equally be applied to a pixel circuit comprising N-type transistors. In the case of being applied to a pixel circuit comprising N-type transistors, the embodiments reduce penetration current as will be described with reference to FIG. 22. In other words, in embodiments of the claimed invention that are applied to N-type transistors, penetration current is reduced. This reduces the power consumption of pixel circuit. The signal diagram according to embodiments of the disclosure explaining the operation of the pixel circuit of FIG. 22 is shown in FIG. 23.

Referring to FIG. 22 and FIG. 23, a scanning period for the pixel circuit is shown. The scanning period includes three phases; the reset phase, the data writing phase and the emission phase. During the reset phase, which commences at time T210, the Write Scan line which is connected to the gate of sampling transistor T40 goes from low to high for a short period of time. This means that sampling transistor T40 conducts and the signal line Vdata is presented to capacitor C. This means that the value of signal Vdata (which in this case is Vofs) is written to capacitor C. In embodiments, Vofs is a black signal which is lower than the threshold value of driving transistor T41. This means that driving transistor T41 is forced to turn off. Additionally, at the same time as the Write Scan line going high, the Auto Zero Scan line moves from low to high. As the Auto Zero Scan line is connected to the gate of reset transistor T42, reset transistor T42 is placed in a conducting state. This prevents current flowing into the anode of light emitting element D22. The Auto Zero Scan line then drops to low at time T211 meaning that reset transistor T42 becomes non-conducting.

At time T212, at the expiration of the reset phase, the writing phase begins. The writing phase begins when the Write Scan line goes high. As the Write Scan line is connected to the gate of sampling transistor T40, sampling transistor T40 begins conducting. As the source of sampling transistor T40 is connected to the Vdata line and the drain of sampling transistor T40 is connected to the capacitor C (which itself is connected between the gate and drain of driving transistor T41), capacitor C begins charging. However, as the source of sampling transistor T40 is in a floating state (as reset transistor T42 is not conducting), the voltage stored in capacitor C is not stable or fixed. It will be noted, however, that although not stable, the voltage across capacitor C will exceed the threshold voltage of driving transistor T41 as the voltage Vsig on the Vdata line is above the threshold voltage of driving transistor T41. This will mean that driving transistor T41 will start to conduct. It is desirable therefore to switch the Auto Zero line from low to high in order to make reset transistor T42 conducting. This will stabilize the voltage stored in capacitor C. However, as will be explained, the inventors have identified that by setting the Auto Zero line high, an undesirable penetration current is generated.

At time T213, the Auto Zero Scan line goes from low to high. This means that reset transistor T42 begins conducting. Accordingly, the voltage at the source of sampling transistor T40 is fixed at a stable voltage (in this case, Vss). This means that capacitor C stores a voltage precisely related to Vsig. In other words, capacitor C stores voltage Vsig-Vss.

As noted above, during the period that reset transistor T42 is switched on by the Auto Zero scan line whilst the voltage across capacitor C is above the threshold voltage, a penetration current will flow through driving transistor T41 and through reset transistor T42. This means that the Auto Zero scan line should be high for a minimum time during this period to minimize the amount of lost power from the pixel circuit. In other words, to reduce the amount of power lost in the pixel circuit due to penetration current, it is desirable to turn on sampling transistor T40 in the during the writing phase while driving transistor T41 is conducting but not before or after driving transistor T41 is conducting.

At time T214, the Write Scan line goes from high to low. This stops sampling transistor T40 from conducting. Accordingly, writing of the value of the Vdata line to capacitor C stops. This means that a stable voltage related to Vsig is stored in capacitor C.

At time T215, the Auto Zero scan line drops from high to low. This means reset transistor T42 stops conducting and the voltage stored in the capacitor C is emitted through element D22. This is the emission period.

It should be noted that although no light emission control transistor is shown in FIG. 22, a light emission control transistor may be placed within a current path from the power supply voltage VCCP to the organic EL element EL, for example between voltage VCCP and driving transistor T36 which is driven by a driving signal connected to the gate of the driving transistor, or the driving transistor T41 and the organic EL element EL. A light emission control signal will switch the light emission control transistor on between period T213 and T214 and during the emission period.

Additionally, as can be seen from the above, the reset transistor T42 resets the anode of the light-emitting element to a predetermined potential at a predetermined timing, in which the reset transistor T42: switches from on to off before the signal voltage Vdata is written to the driving transistor T41; switches from off to on while the signal voltage Vdata is being written to the driving transistor T41 after the switching; and switches from on to off before a period in which the light-emitting element D22 emits light after the writing. By performing this switching, the pixel circuit including n-type transistors reduces penetration current and thus reduces power consumption in the pixel circuit.

Two further timing diagrams which may be applied to the pixel circuit of FIG. 22 are shown in FIG. 24 and FIG. 25. These two timing diagrams emphasize the advantages associated with the timing diagram of FIG. 23 which accords to embodiments of the disclosure.

Referring to FIG. 22 and FIG. 24, the Reset period commences at time T210. At time T240, the Write Signal goes high for a short period of time. This switches sampling transistor T40 on. Vofs (which is a black level signal) is therefore presented to capacitor C which begins to charge to Vofs. Also at time T210, the Auto Zero scan line goes high which switches reset transistor T42 on. This allows voltage Vss-Vofs to be presented to the anode of light-emitting element D22.

At time T211, the voltage on Vdata increases to Vsig. At time T212, the Reset period ends and the Writing period commences. This means that the Write Scan line goes high and sampling transistor T40 begins conducting. Therefore, Vsig is applied to capacitor C. After a short period of time, the voltage across capacitor C will exceed the threshold voltage of drive transistor T41. As will be appreciated by the skilled person, the time taken to charge capacitor C so that the voltage across capacitor C exceeds the threshold voltage of reset transistor T42 is quite short relative to the duration of the Writing Period. Moreover, the value of Vsig will always exceed the threshold voltage of sampling transistor T40.

Once the voltage across capacitor C exceeds the threshold voltage, sampling transistor T40 will switch on. As the Auto Zero line is still high, reset transistor T42 will be conducting. This means a penetrative current will flow through drive transistor T41 and reset transistor T42 for the entire Writing period. This increases power consumption in the pixel circuit of FIG. 22 compared with the timing diagram of FIG. 23 that accords to embodiments of the disclosure.

The other timing events are the same as described in FIG. 23 and so will not be described herein for brevity.

Referring to FIG. 22 and FIG. 25, another timing diagram emphasizing the advantages of the timing diagram of FIG. 23 is shown.

The timing diagram of FIG. 25 differs from the timing diagram of FIG. 24 in that the Auto Zero line is switched low at step T211. This stops the penetrative current flowing through transistor T38 during the Write period. However, this timing sequence creates a further problem. Specifically, during the Write period (starting at time T212), the gate of sampling transistor T40 goes high meaning that capacitor C begins charging to voltage Vsig at the gate of drive transistor T41. However, as the Auto Zero line is low during the Write period, the other side of capacitor C (connected to the drain of drive transistor T41) is not at a steady voltage (i.e. it is left in a "floating" state). This means that the voltage stored in capacitor C is not precise and so the voltage applied to the light-emitting element D22 during the emission period is not accurate. This reduces the quality of the output.

Accordingly, by applying the timing diagram of FIG. 23 to the pixel circuit of FIG. 22, according to embodiments of the disclosure, a high quality image is generated with reduced power consumption.

Although the foregoing has been described with reference to the transistors being Field Effect Transistors, the disclosure is not so limited. Embodiments of the disclosure may be applied to any kind of transistor type switch Although the foregoing has been applied to a pixel circuit including an light emitting element D22 whose anode is connected to driving transistor T41, the disclosure is not so limited. The cathode of light-emitting element D22 may instead be connected to the driving transistor T41. Of course, other voltage levels may need to be provided or adjusted in order for the light emitting element D22 to function correctly, but this is within the skilled person's knowledge.

Although the foregoing has been described with reference to a particular circuit layout, the skilled person will appreciate that other circuit layouts having similar functionality are envisaged. For example, a separate capacitor C is shown in FIG. 22. However, the skilled person will appreciate that the physical parameters of a Field Effect Transistor (such as the physical parameters of driving transistor T41) may be adjusted to provide the required capacitance within the driving transistor T41.

2. Conclusion

According to the embodiment of the present disclosure as described above, there is provided a display device that includes a pixel circuit in which a transistor for performing control to prevent a self-luminous element from emitting light in a non-light emission period is provided for an anode of the self-luminous element, and provides two effects of an improvement in contrast and prevention of horizontal crosstalk.

In addition, an electronic apparatus including the display device according to the embodiment of the present disclosure is also similarly provided. The electronic apparatus including the display device according to the embodiment of the present disclosure provides two effects of an improvement in contrast and prevention of horizontal crosstalk. Examples of such an electronic apparatus include a television, a mobile phone such as a smartphone, a tablet-type mobile terminal, a personal computer, a portable game console, a portable music player, a digital still camera, a digital video camera, a watch-type mobile terminal, a wearable device, and the like.

It should be understood by those skilled in the art that various modifications, combinations, sub-combinations and alterations may occur depending on design requirements and other factors insofar as they are within the scope of the appended claims or the equivalents thereof.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A pixel circuit including:

a light-emitting element;

a driving transistor whose source is connected to an anode of the light-emitting element;

a sampling transistor, whose source is connected to a gate of the driving transistor, that samples a signal voltage to be written to the driving transistor; and a reset transistor that resets the anode of the light-emitting element to a predetermined potential at a predetermined timing, in which the reset transistor switches from on to off before the signal voltage is written to the driving transistor, switches from off to on while the signal voltage is being written to the driving transistor after the switching, and switches from on to off before a period in which the light-emitting element emits light after the writing.

(2)

The pixel circuit according to (1), in which the reset transistor switches from off to on while the signal voltage is being written to the driving transistor after the sampling transistor switches from off to on.

(3)

The pixel circuit according to (1) or (2), in which the reset transistor switches from on to off after the writing of the signal voltage to the driving transistor ends and the sampling transistor switches from on to off.

(4)

The pixel circuit according to any one of (1) to (3), further including a light emission control transistor, whose source is connected to a drain of the driving transistor, that switches from off to on in the period in which the light-emitting element emits light.

(5)

The pixel circuit according to (4), in which the light emission control transistor is a P-channel transistor.

(6)

The pixel circuit according to any one of (1) to (5), in which the reset transistor is a P-channel transistor.

(7)

The pixel circuit according to any one of (1) to (6), in which the driving transistor is a P-channel transistor.

(8)

The pixel circuit according to any one of (1) to (6), in which the driving transistor is a N-channel transistor.

(9)

A display device including:

a pixel array section in which pixel circuits, each of which is the pixel circuit according to any one of (1) to (7), are arranged; and a driving circuit that drives the pixel array section.

(10)

An electronic apparatus including the display device according to (9).

(11)

A method for controlling a pixel circuit, the pixel circuit including a light-emitting element, a driving transistor whose source is connected to an anode of the light-emitting element, a sampling transistor, whose source is connected to a gate of the driving transistor, that samples a signal voltage to be written to the driving transistor, and a reset transistor that resets the anode of the light-emitting element to a predetermined potential at a predetermined timing, the method including:

the reset transistor switching from on to off before the signal voltage is written to the driving transistor;

the reset transistor switching from off to on while the signal voltage is being written to the driving transistor; and the reset transistor switching from on to off before a period in which the light-emitting element emits light after the writing.

REFERENCE SIGNS LIST

100 display device
110 pixel section
111B pixel
111G pixel
111R pixel
120 horizontal selector
130 vertical scanner
131 auto-zero scanner
132 driving scanner
133 writing scanner
C1 capacitor
C2 capacitor
Cp parasitic capacitance
Cs capacitor
DS signal
EL organic EL element
Gate gate potential
SCN scan line
T1 transistor
T2 transistor
T3 transistor
T4 transistor
D22 light-emitting element
T40 sampling transistor
T41 driving transistor
T42 reset transistor

The invention claimed is:

1. A pixel circuit comprising:

a light-emitting element;

a capacitor;

a driving transistor including a source connected to an anode of the light-emitting element and configured to supply a driving current from a power voltage line to the light-emitting element according to a voltage stored in the capacitor;

a sampling transistor including a source connected to the capacitor and a gate of the driving transistor, and configured to sample a signal voltage to be written to the capacitor; and a reset transistor configured to reset the anode of the light-emitting element to a predetermined potential at a predetermined timing, wherein the reset transistor is configured to perform a first switch from on to off before the signal voltage is written to the capacitor, a second switch from off to on while the signal voltage is being written to the capacitor, and a third switch from on to off before a period in which the light-emitting element emits light and after the signal voltage is written to the capacitor.

2. The pixel circuit according to claim 1, wherein the second switch occurs after the sampling transistor switches from off to on.

3. The pixel circuit according to claim 1, wherein the third switch occurs after the writing of the signal voltage to the capacitor ends and after the sampling transistor switches from on to off.

4. The pixel circuit according to claim 1, further comprising:

a light emission control transistor including a source connected to a drain of the driving transistor, and configured to switch from off to on in the period in which the light-emitting element emits light.

5. The pixel circuit according to claim 4, wherein the light emission control transistor is a P-channel transistor.

6. The pixel circuit according to claim 1, wherein the reset transistor is a P-channel transistor.

7. The pixel circuit according to claim 1, wherein the driving transistor is a P-channel transistor.

8. The pixel circuit according to claim 1, wherein the driving transistor is an N-channel transistor.

9. A display device comprising:

a pixel array section in which pixel circuits, each of which is the pixel circuit according to claim 1, are arranged; and a driving circuit that drives the pixel array section.

10. An electronic apparatus comprising the display device according to claim 9.

11. The display device according to claim 9, wherein the second switch occurs after the sampling transistor switches from off to on.

12. The display device according to claim 9, wherein the third switch occurs after the writing of the signal voltage to the capacitor ends and after the sampling transistor switches from on to off.

13. The display device according to claim 9, wherein the pixel circuit further comprises:

a light emission control transistor including a source connected to a drain of the driving transistor, and configured to switch from off to on in the period in which the light-emitting element emits light.

14. The display device according to claim 13, wherein the light emission control transistor is a P-channel transistor.

15. The display device according to claim 9, wherein the reset transistor is a P-channel transistor.

16. The display device according to claim 9, wherein the driving transistor is a P-channel transistor.

17. The display device according to claim 9, wherein the driving transistor is an N-channel transistor.

18. The display device according to claim 9, wherein the source of the driving transistor is directly electrically connected to the anode of the light-emitting element.

19. The pixel circuit according to claim 1, wherein the source of the driving transistor is directly electrically connected to the anode of the light-emitting element.

20. A method for controlling a pixel circuit, the pixel circuit including a light-emitting element, a capacitor, a driving transistor including a source connected to an anode of the light-emitting element and configured to supply a driving current from a power voltage line to the light-emitting element according to a voltage stored in the capacitor, a sampling transistor, whose source is connected to the capacitor and a gate of the driving transistor, that samples a signal voltage to be written to the capacitor, and a reset transistor that resets the anode of the light-emitting element to a predetermined potential at a predetermined timing, the method comprising:

switching the reset transistor from on to off before the signal voltage is written to the capacitor;

switching the reset transistor from off to on while the signal voltage is being written to the capacitor; and switching the reset transistor from on to off before a period in which the light-emitting element emits light after the signal voltage is written to the capacitor.

* * * * *